US008813812B2

(12) United States Patent
Kamel et al.

(10) Patent No.: US 8,813,812 B2
(45) Date of Patent: Aug. 26, 2014

(54) TURBINE COMPONENT CASTING CORE WITH HIGH RESOLUTION REGION

(71) Applicants: Ahmed Kamel, Orlando, FL (US); Gary B. Merrill, Orlando, FL (US)

(72) Inventors: Ahmed Kamel, Orlando, FL (US); Gary B. Merrill, Orlando, FL (US)

(73) Assignees: Siemens Energy, Inc., Orlando, FL (US); Mikro Systems, Inc., Charlottesville, VA (US)

( * ) Notice: Subject to any disclaimer, the term of this patent is extended or adjusted under 35 U.S.C. 154(b) by 0 days.

(21) Appl. No.: 13/974,651

(22) Filed: Aug. 23, 2013

(65) Prior Publication Data

US 2013/0341822 A1 Dec. 26, 2013

Related U.S. Application Data

(63) Continuation-in-part of application No. 12/712,632, filed on Feb. 25, 2010, now abandoned.

(51) Int. Cl.
*B22C 9/10* (2006.01)

(52) U.S. Cl.
CPC ..... *B22C 9/103* (2013.01)
USPC ..... 164/28; 164/369

(58) Field of Classification Search
CPC ..... B22C 9/10; B22C 9/103
USPC ..... 164/369, 516, 517, 518, 519, 28
See application file for complete search history.

(56) References Cited

U.S. PATENT DOCUMENTS

| | | | | |
|---|---|---|---|---|
| 5,394,932 | A * | 3/1995 | Carozza et al. | 164/137 |
| 2004/0156478 | A1* | 8/2004 | Appleby et al. | 378/147 |
| 2007/0131379 | A1* | 6/2007 | Beddard et al. | 164/369 |

* cited by examiner

*Primary Examiner* — Kevin P Kerns

(57) ABSTRACT

A hollow turbine engine component with complex internal features can include a first region and a second, high resolution region. The first region can be defined by a first ceramic core piece formed by any conventional process, such as by injection molding or transfer molding. The second region can be defined by a second ceramic core piece formed separately by a method effective to produce high resolution features, such as tomo lithographic molding. The first core piece and the second core piece can be joined by interlocking engagement that once subjected to an intermediate thermal heat treatment process thermally deform to form a three dimensional interlocking joint between the first and second core pieces by allowing thermal creep to irreversibly interlock the first and second core pieces together such that the joint becomes physically locked together providing joint stability through thermal processing.

16 Claims, 14 Drawing Sheets

TURBINE COMPONENT CASTING CORE WITH HIGH RESOLUTION REGION

CROSS-REFERENCE TO RELATED APPLICATION

This application is a continuation-in-part patent application of U.S. Utility patent application Ser. No. 12/712,632, filed Feb. 25, 2010, now abandoned, the entirety of which is incorporated herein.

STATEMENT REGARDING FEDERALLY SPONSORED DEVELOPMENT

Development for this invention was supported in part by Contract No. DE-FC26-05NT42644 awarded by the United States Department of Energy. Accordingly, the United States Government may have certain rights in this invention.

FIELD OF THE INVENTION

Aspects of the invention relate in general to turbine engine components and, more particularly, to cast turbine engine components.

BACKGROUND OF THE INVENTION

In a turbine engine, many components, such as turbine blades or vanes, are exposed to hot gases during engine operation. In order to withstand the operational environment, these components are typically cooled during engine operation. To promote cooling, these components can include a number of internal features, such as cooling channels and cavities. The inclusion of such features can dramatically increase the difficulty of manufacturing the component. Thus, the ability to manufacture a cooled turbine component economically is essential to the viability of any design.

Turbine blades are typically made by investment casting using a core to form the internal features of the blade. As a result, the core is critical to achieving the features needed to obtain the desired cooling performance of the blade. Conventionally, the core is manufactured by injection molding (low pressure or high pressure) or transfer molding. In either process, precision dies are required. The directions in which the segments of the dies are pulled apart to remove the core are important factors in the design of the core and impose limitations on the core design, as it must be ensured that the various die segments can be withdrawn without interference. As the required number of separation planes increases, it becomes increasingly challenging to separate the dies and, at some point, it becomes impossible. Thus, the design of the core can ultimately affect the design of the blade.

With the drive toward advanced cooling schemes, including near wall cooling, conventional core production methods alone will not be able to meet the requirements of the advanced designs. Thus, there is a need for a system and method that can facilitate the inclusion of advanced internal cooling features in turbine engine components.

SUMMARY OF THE INVENTION

Aspects of the invention are directed to a method of forming a core for use in casting a turbine engine component. The method includes the steps of forming a normal resolution region of the core, and forming a high resolution region of the core using a method effective to produce high resolution features. The core may be a multi-wall core.

In one embodiment, the normal resolution region can be defined by a first core piece, and the high resolution region can be defined by a second core piece. In such case, the method can include the step of joining the first and second core pieces. In some instances, the step of joining the first and second core pieces can be performed outside of a mold. The high resolution region can be formed by tomolithographic molding. At least a portion of the first core piece can be made using a method effective to produce high resolution features, which can be, for example, tomolithographic molding.

The first core piece can include a cavity within the first core piece that extends from a inner side to an outer side. The second core piece can include a protrusion. In such case, the joining step can result in the protrusion being received in the cavity. At least a portion of the protrusion can be heated. The heated protrusion can be formed such that the first and second core pieces are in interlocking engagement. In one embodiment, the forming step can include folding the protrusion over onto the outer side of the first core piece. A recess can be formed in the first core piece such that the recess receives at least a part of the folded over portion of the protrusion. Thus, the protrusion can be substantially flush with the outer side of the first core piece. In another embodiment, the forming step can include shaping at least a portion of the protrusion to substantially correspond to at least a portion of the cavity.

The first core piece can include a cavity therein, and the second core piece can include a protrusion. The protrusion can include a first portion and a second portion. The first portion can be configured to be received in the cavity, and the second portion can be configured to prevent receipt into the cavity. In such case, the joining step can result in only the first portion of the protrusion being received in the cavity. As a result, a desired spacing between the first and second core pieces can be maintained. The first portion of the protrusion can be heated and formed such that the first and second core pieces are in interlocking engagement The first core piece can include a plurality of recesses, and the second core piece can include a plurality of protrusions. The recesses and the protrusions can be configured for interlocking engagement. The joining step can result in each protrusion being received in a respective one of the recesses. Any suitable type of interlock can be employed. In one embodiment, the recesses can be female dovetails, and the protrusions can be male dovetails. In some instances, a gap can be formed between each recess and protrusion received therein. In such case, the method can further include the steps of: applying a ceramic material in at least a portion of the gap and firing the joined first and second core pieces.

In one embodiment, both the first core piece and the second core piece can be fully fired during the joining step. In another embodiment, at least one of the first core piece and the second core piece can be in a green state. The first core piece and/or the second core piece can be formed with a binder comprising a solvent, a plasticizer, and at least one of a urethane or an epoxy resin. In such case, the method can further include the step of selecting the solvent, the plasticizer, and the at least one of a urethane or an epoxy resin to achieve a target property of the first core piece and/or the second core piece in the green state. The first core piece and/or the second core piece can be heated in the green state to a cure temperature. The first core piece and/or the second core piece can be thermally formed to a target configuration.

In one embodiment, the first core piece can include a recess. In such case, the method can further include forming the second core piece with a foil member. A portion of the foil member can be embedded in the second core piece, and a portion of the foil member can protrude beyond the second core piece. In such case, the joining step includes inserting the protruding portion of the foil member into the recess of the first core piece.

The method can further include the steps of: forming a core print separately from the core, and joining the core print to the core. The core can include either a plurality of recesses or a plurality of protrusions; the core print can include the opposite one of a plurality of protrusions and a plurality of protrusions. The recesses and the protrusions are configured for interlocking engagement, wherein the joining step results in each protrusion being received in a respective one of the recesses. In some instances, the method can include the additional step of forming a core lock in the core print.

Other embodiments according to aspects of the invention are directed to a method of joining a multi-piece core for a cast airfoil. In such a method, a first ceramic core piece is formed. The first core piece is generally shaped as an airfoil body portion and has either a plurality of recesses or a plurality of protrusions. The first core piece includes an engaging surface. At least a portion of the first ceramic core piece can be made using a method effective to produce high resolution features, such as, for example, tomolithographic molding.

A second ceramic core piece is formed separately from the first core piece. The second core piece has a high resolution region. The second core piece has an engaging surface. The second core piece has an opposite one of a plurality of protrusions and a plurality of recesses. The recesses and the protrusions of the first and second core pieces are configured for substantially interlocking engagement. The second core piece is generally shaped as a trailing edge portion of an airfoil. The step of separately forming the second ceramic core piece can be performed using a method effective to produce high resolution features. One example of a method effective to produce high resolution features is tomo lithographic molding.

The first core piece and the second core piece can be joined such that each protrusion is received in a respective recess and such that the engaging surfaces abut. As a result, a core assembly is formed. The joining step can be performed outside of a mold.

In one embodiment, both the first core piece and the second core piece can be in a green state during the joining step. In such case, at least the second core piece can be formed with a binder comprising a solvent, a plasticizer, and at least one of a urethane or an epoxy resin. The method can further include the step of selecting the solvent, the plasticizer, and the at least one of a urethane or an epoxy resin to achieve a target property of the second core piece in the green state. While in the green state, the second core piece can be heated to a cure temperature. At that point, the second core piece can be thermally formed to a target configuration.

The first core piece can include a recess and further including the step of forming the second core piece with a foil member, wherein a portion of the foil member is embedded in the second core piece and a portion of the foil member protrudes beyond the engaging surface of the second core piece; and wherein the joining step comprises inserting the protruding portion of the foil member into the recess of the first core piece. The first core piece and/or the second core piece can be a multi-wall core.

The method can further include the steps of: forming a core print separately from the first and second core pieces, and joining the core print to at least one of the first core piece and the second core piece. The first core piece and/or the second core piece can include either a plurality of recesses or a plurality of protrusions. The core print can include the opposite one of a plurality of protrusions and a plurality of protrusions. The recesses and the protrusions can be configured for interlocking engagement. The step of joining the core print to the first core piece and/or the second core piece results in each protrusion being received in a respective one of the recesses. In one embodiment, a core lock can be formed in the core print.

In another respect, aspects of the invention are directed to a casting core for a turbine engine component. The casting core includes a ceramic core body having a first region of normal resolution detail and a second region of high resolution detail. In one embodiment, the first region can be an airfoil body portion, and the second region can be an airfoil trailing edge portion. The core body may be a multi-wall core.

In some instances, the first region can be defined by a first core piece, and the second region can be defined by a separate second core piece. The second core piece can be a monolithic structure. A foil member can extend between and into engagement with the first and second core pieces. A portion of the foil member can be embedded in the second core piece, and another portion of the foil member can be received in a recess in the first core piece.

The first ceramic core piece can have a plurality of recesses, and the second ceramic core piece can have a plurality of protrusions. Each protrusion can be adapted for interlocking engagement with a respective one of the recesses. Each protrusion can be received in a respective one of the recesses so as to join the first ceramic core piece to the second ceramic core piece. A gap may be formed between each recess and respective protrusion received in the recess. The gap can be filled with a ceramic material.

The recesses can be female dovetails, and the protrusions can be male dovetails. One or more of the male dovetails can include a thickness surface. The thickness surface can be angled at less than 90 degrees relative to the engaging surface of the second ceramic core piece. Each dovetail can include a first side face and a second side face and at least one thickness surface. The thickness surface can include a plurality of protruding undercuts.

The casting core can further include a core print formed separately from but attached to the ceramic core body. A core lock can be formed in the core print. The core body can include either a plurality of recesses or a plurality of protrusions; the core print can include the opposite one of a plurality of protrusions and a plurality of protrusions. The recesses and the protrusions can be configured for interlocking engagement. Each protrusion can be received in a respective one of the recesses.

Other embodiments of interlocking engagement between the first and second core pieces may be used to irreversibly interlock first and second core pieces together by thermal deformation to create a three dimensional interlocking joint. In at least one embodiment, the first and second core pieces may be used to form at least a portion of a turbine airfoil for a gas turbine engine, such as, but not, limited to a turbine blade. The first core piece may be formed from a normal resolution region of the core using a first process of molding. The second core piece may be formed from a high resolution region of the core using lithographic molding, which is a method of molding different than the first process and effective to produce high resolution features. The high resolution region may have one or more high resolution features selected from the group consisting of a recess, cavity, opening, protrusion, channel, groove, slot, and depression. The first core piece may include a cavity, and the second core piece may include a protrusion. The first and second core pieces may be joined such that a first portion of the protrusion is received in at least a portion of the cavity. The protrusion may be heated via an intermediate thermal heat treatment process causing the protrusion to thermally deform to create a three dimensional interlocking joint between the first and second core pieces by allowing thermal creep to irreversibly interlock the first and second core pieces together such that the joint becomes physically locked together providing joint stability through thermal processing.

The protrusion may be formed from first and second protrusions extending from the second core piece at acute angles relative to a longitudinal axis in a first perspective, which may be the Z-Y plane. The first perspective may be orthogonal to a plane defined by the X-Y plane. In addition, the first protrusion may have a dovetail shape with outer sidewalls extending axially away from each other at acute angles from the longitudinal axis in a second perspective in the X-Y plane, which is 90 degrees to the first perspective defined in the Z-Y plane. The first and second protrusions may be separated by open space positioned therebetween. The cavity in the first core piece may include first and second cavities formed to receive the first and second protrusions. The first cavity may have dovetail shaped sidewalls and may be sized to receive the first protrusion once the first protrusion is subjected to the intermediate thermal heat treatment process and thermally deforms into position in the first cavity forming the irreversibly interlocked joint, whereby a portion of the first core piece separates the first cavity from the second cavity. The second protrusion may have a dovetail shape with outer sidewalls extending axially away from each other at acute angles from the longitudinal axis in a second perspective in a X-Y plane that is 90 degrees to the first perspective in the Z-Y plane. The second cavity may have dovetail shaped sidewalls and may be sized to receive the second protrusion once the second protrusion is subjected to the intermediate thermal heat treatment process and thermally deforms into position in the second cavity forming the irreversibly interlocked joint.

The protrusion may form a tongue in groove joint that after being subject to the intermediate thermal heat treatment process forms an irreversibly interlocked joint. The cavity may be sized to receive the protrusion and to enable the protrusion to thermally deform during an intermediate thermal heat treatment process. The cavity may be offset from a lateral contact surface such that the cavity may be exposed through the first core piece via a neck having a cross-sectional area that is less than the cavity. The first and second core pieces may be in a green state when the first and second core pieces are joined such that the first portion of the protrusion is received in at least a portion of the cavity. As such, when the protrusion is thermally deformed during an intermediate thermal heat treatment process, the protrusion may not be removed from the cavity, thereby keeping the first and second core pieces attached to each other. A locking member may be inserted into the cavity housing the protrusion and into at least a portion of space in the cavity which was vacated by the protrusion once the protrusion was thermally deformed during the intermediate thermal heat treatment process. The neck may also be offset relative to the cavity such that the neck is closer to a first outer surface of the first core piece than a second outer surface. In at least one embodiment, the first and second core pieces may be configured such that the first portion of the protrusion is received in at least a portion of the cavity comprises joining first and second core pieces outside of a mold.

DETAILED DESCRIPTION OF EMBODIMENTS OF THE INVENTION

As shown in FIGS. 1-18, embodiments of the invention are directed to a casting core system with one or more high resolution regions for use in casting a turbine engine component. Aspects of the invention will be described in connection with a casting core for a turbine airfoil, but the detailed description is intended only as exemplary. Indeed, aspects of the invention can be used in connection with any hollow cast turbine engine component, especially those with complex internal features. Embodiments of the invention are shown in FIGS. 1-8, but the present invention is not limited to the illustrated structure or application.

Figure 1:
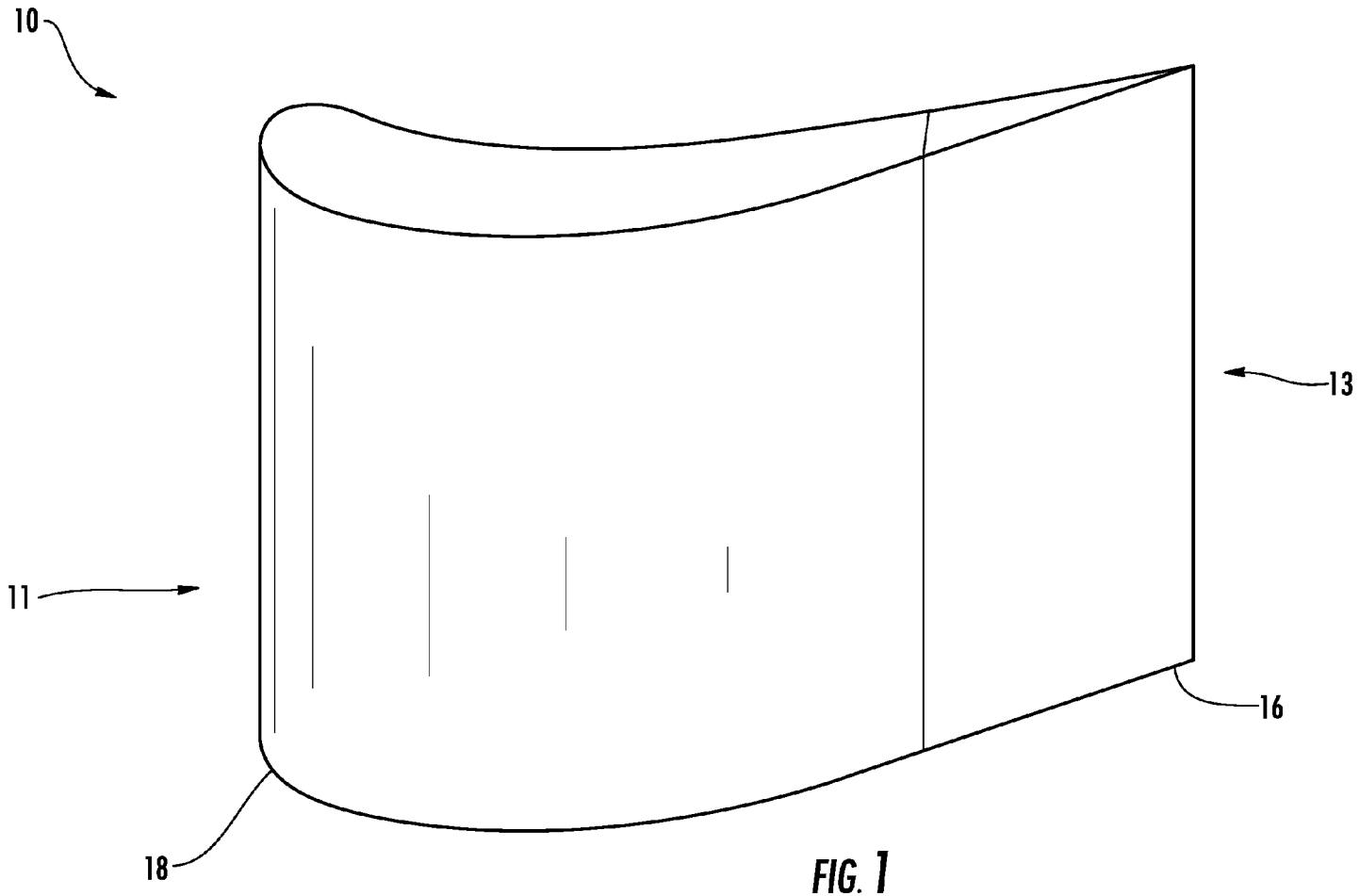
FIG. 1 is a perspective view of a casting core having a first region and a second region according to aspects of the invention.

Referring to FIG. 1, a casting core 10 according to aspects of the invention is shown. The casting core 10 can include a first region 11 and a second region 13. In one embodiment, the core 10 can be used in connection with the casting of a turbine blade or vane. In such case, the second region 13 can define an airfoil trailing edge portion 16 of the core 10, and the first region 11 can define an airfoil body portion 18 of the core 10.

The first region 11 can include one or more features, including, for example, recesses, cavities, openings, protrusions, channels, grooves, slots, and/or depressions. These features can be of a normal resolution; that is, these features can be produced by conventional casting techniques, including, for example, injection molding (low pressure or high pressure) or transfer molding. The first region 11 can be sized and shaped as necessary, depending on the ultimate part being made.

The second region 13 can be a high resolution region having one or more high resolution features or details, which can be, for example, recesses, cavities, openings, protrusions, channels, grooves, slots, and/or depressions, depending on the desired internal features in the part ultimately being made. The high resolution region of the core can be used to form internal features or details in the ultimate part being made. Such features or details can be effective to optimize cooling in the ultimate part being cast.

A high resolution region is beyond the natural capacity or scope of conventional core formation methods. For example, a high resolution region is one that would require more than three planes of die separation using conventional core formation techniques. Thus, according to aspects of the invention, the second region 13 can include one or more high resolution features that were not previously attainable using conventional core formation techniques. It should be noted that, while the following description will be directed to a casting core 10 with one high resolution region 13, it will be understood that a casting core in accordance with aspects of the invention can have a plurality of high resolution regions. Further, while the high resolution region is shown as being associated with the trailing edge portion 16 of the casting core 10, it will be understood that embodiments of the invention are not limited to such a location. Indeed, in some instances, the trailing edge portion 16 may not have a high resolution region. The high resolution region can be applied in any suitable location, including in the airfoil body portion 18.

The casting core 10 can be made of any suitable material. In one embodiment, the casting core 10 can be made of ceramic, including, for example, silica-based ceramic compositions. The first and second regions 11, 13 of the casting core 10 can be made of the same material. Alternatively, the first and second regions 11, 13 of the casting core 10 can be made of different materials.

Figure 6:
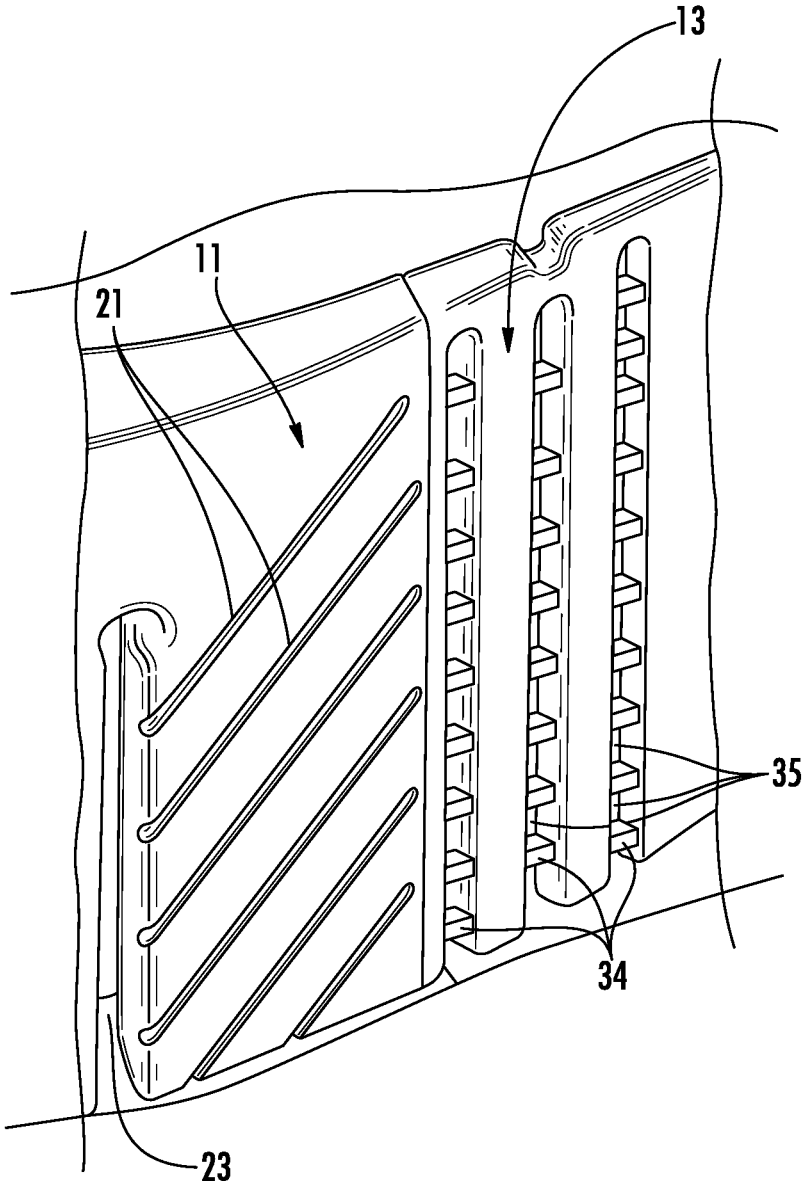
FIG. 6 is a close up view of a casting core according to aspects of the invention, showing a first region with normal resolution features and a second region with high resolution features.
Figure 7:
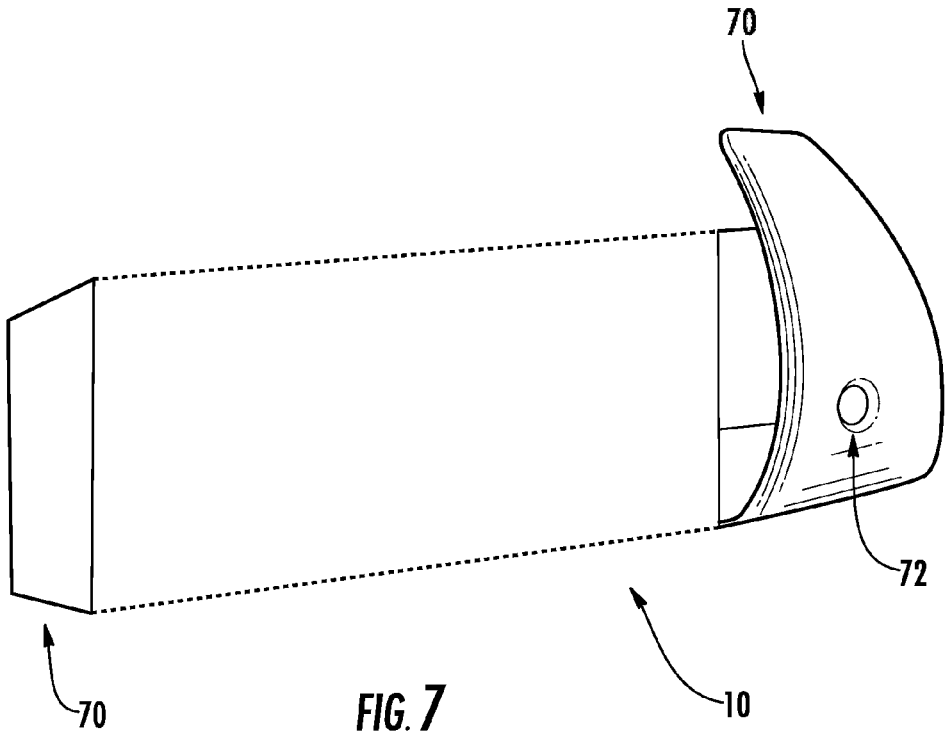
FIG. 7 is a perspective view of a casting core with core prints and a core lock according to aspects of the invention.

The first region 11 and the second region 13 can be sized and/or shaped as necessary, depending on the ultimate part being made and the desired internal features therein. According to aspects of the invention, the second region 13 can generally have more complex, higher resolution, critical and/or intricate features than, the first region 11. FIG. 6 shows an example of the relative complexity of the first and second regions 11, 13. As can be seen, the first region 11 can include a plurality of elongated channels 21 extending at a depth in the first region 11 and/or an elongated passage 23 extending through the core in the first region 11. In contrast, the second region 13 can include one or more high resolution features. Such high resolution features can include short, thin-walled members or cross-overs 34 in a highly intricate arrangement. The cross-overs 34 can be formed by passages 35 that extend though the thickness of the core 10 in the second region 13. As a result, the cross-overs 34 are not surrounded by other material along their length. In some instances, there can be a greater quantity of features in the high resolution region than in the normal resolution region.

A casting core 10 according to aspects of the invention can be formed in any suitable manner. In one embodiment, the first and second regions 11, 13 can be formed in a single monolithic core. Alternatively, the first and second regions 11, 13 can be formed as separate pieces joined together to form a core assembly, as is shown in FIGS. 2-5. In such case, the first region 11 can be defined by a first core piece 12, and the second region 13 can be defined by a second core piece 14. The second core piece 14 can be formed separately from the first core piece 12.

A normal resolution region, such as the first region 11 and/or the first core piece 12, can be made using any suitable core formation techniques, including, for example, conventional techniques like injection molding (low pressure or high pressure) or transfer molding. A high resolution region, such as the second region 13 and/or the second core piece 14, can be formed by a method effective to produce the high resolution features and/or details. That is, a high resolution region can be formed by a process that can yield high resolution features or detail that cannot be achieved using conventional core formation processes.

One example of a process that can yield high resolution features or detail is tomolithographic molding, a process which is available from Mikro Systems Inc., Charlottesville, Va. Tomolithographic molding is described in U.S. Pat. Nos. 7,411,204; 7,410,606; and 7,141,812 and U.S. Patent Application Publication Nos. 2004/0156478, 2008/0053638 and 2009/0084933, each of which is incorporated herein by reference. Tomolithographic molding can provide greater geometric and dimensional control with respect to high resolution features compared to conventional core formation processes. Tomolithographic molding can create features down to 50 microns.

Generally, tomolithographic molding can include a number of constituent processes, such as lithographic micromachining, precision stack lamination, molding, and casting processes. Initially, a three dimensional digital model can be transformed into a series of lithographic masks. Each mask can represent a cross-sectional slice of the desired three dimensional solid (in this case, the second core piece 14). Each mask can then be used to lithographically machine an exact replica from metal foil or polymeric film. The foils and/or films ("toma") can be stack-laminated to form a durable, ultra-high precision master mold. Finally, material can be poured into the mold to cast a high-fidelity, monolithic part.

While processes that can yield high resolution features or detail are effective in producing a high quality casting core, it may not be necessary to make the entire core using such processes. One or more criteria can be used to determine whether to employ a process effective to produce high resolution features and/or details to form one or more regions of the core 10, as opposed to using conventional casting techniques. For instance, one criterion can be the complexity of the region. A method effective to produce high resolution features and/or details can be used in connection with those regions of the core that have complex, critical and/or intricate features, especially compared to other portions of the core. For instance, in a casting core for a turbine blade, a large number of cooling passages and/or a complicated trailing edge region can make conventional tooling overly complex, if not impossible, thereby weighing in favor of using a method effective to produce high resolution features and/or details, such as tomolithographic molding.

Alternatively or in addition, another criterion can be the complexity of the core injection die that would be needed using conventional core formation techniques. In conventional core formation methods, the maximum number of planes in which a die can be pulled apart is typically three. If a core design would require more than three planes for pulling the die apart, then it may become cost prohibitive under conventional techniques, if not impossible due to the lack of technology or physical interferences. Thus, it may be more cost effective to use an alternative method effective to produce the high resolution features and/or detail, such as tomolithographic molding, to produce at least a portion of the core.

An additional criterion, which can be in addition or as an alternative to one or more of the above criteria, can be time and/or cost. In some instances, the time involved and/or cost associated with forming at least a portion of the casting core using conventional techniques can exceed the time and/or cost associated with forming at least a portion of the casting core by methods effective to produce high resolution features and/or detail, such as those described herein. In such cases, it may be more desirable to form at least a portion of the core by methods effective to produce high resolution features and/or detail.

When the first and second regions 11, 13 are formed by separate core pieces 12, 14, as described above, the core pieces 12, 14 can be joined in any suitable manner to form a core assembly. One manner of joining the core pieces 12, 14 is described herein, but aspects of the invention are not limited to any particular manner of joining. As an example, the first and/or second core pieces 12, 14 can have one or more features to facilitate such joining. For instance, the first and second core pieces 12, 14 can be joined by way of a plurality of interlocking features. For example, one of the core pieces 12, 14 can have at least one protrusion and the other one of the core pieces 12, 14 can have at least one recess. At least a portion of each protrusion and each recess can be adapted for substantially interlocking engagement with each other. For instance, the protrusions and the recesses can be configured as male and female dovetails, generally spherical protrusions and recesses, or generally T-shaped protrusions and recesses, just to name a few possibilities. Additional examples of suitable interlocking engagements are described herein as well as in U.S. Patent Application Publication No. 2009/0084933, which is incorporated herein by reference. Each protrusion can be received in a respective one of the recesses.

Figure 2:
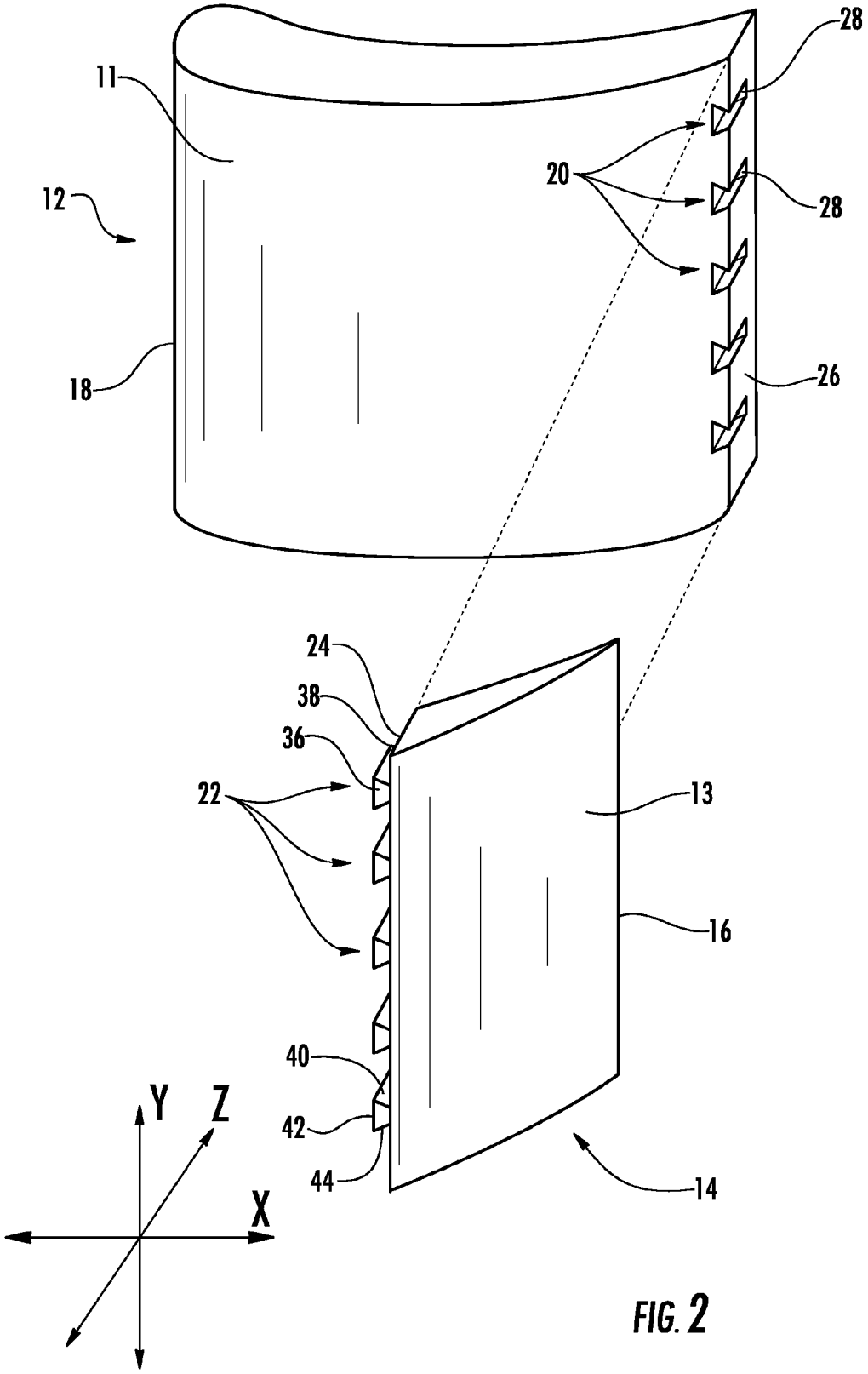
FIG. 2 is a perspective exploded view of a casting core assembly according to aspects of the invention, showing a first casting core piece and a second casting core piece.

In one embodiment, the first core piece 12 can include a plurality of female dovetails 20, such as in the form of slots, and the second core piece 14 can include a plurality of male dovetails 22, as shown in FIG. 2. While the drawing figures and the following description will be directed to this arrangement, it will be understood that, alternatively or in addition, the first core piece 12 can include a plurality of male dovetails (not shown), and the second core piece 14 can include a plurality of female dovetails (not shown). Further, as noted above, there are several other manners in which core pieces can be joined in accordance with aspects of the invention.

It will be appreciated that the male dovetails 22 would ordinarily be difficult to make using conventional core formation techniques, particularly when the second core piece 14 is made of ceramic. However, because the second core piece 14 is made by using a process effective to produce high resolution features, such as tomolithographic molding, the male dovetails 22 can be provided on the second core piece 14 with a high degree of reliability as well as control over the features of the male dovetails 22.

There can be any number of male dovetails 22 and female dovetails 20. In one embodiment, there can be four male dovetails 22 and four female dovetails 20. The male dovetails 22 can all be substantially the same size and shape, or at least one of the male dovetails 22 can be a different size and/or shape. Naturally, the female dovetails 20 are sized and shaped to receive the male dovetails 22.

Figure 4:
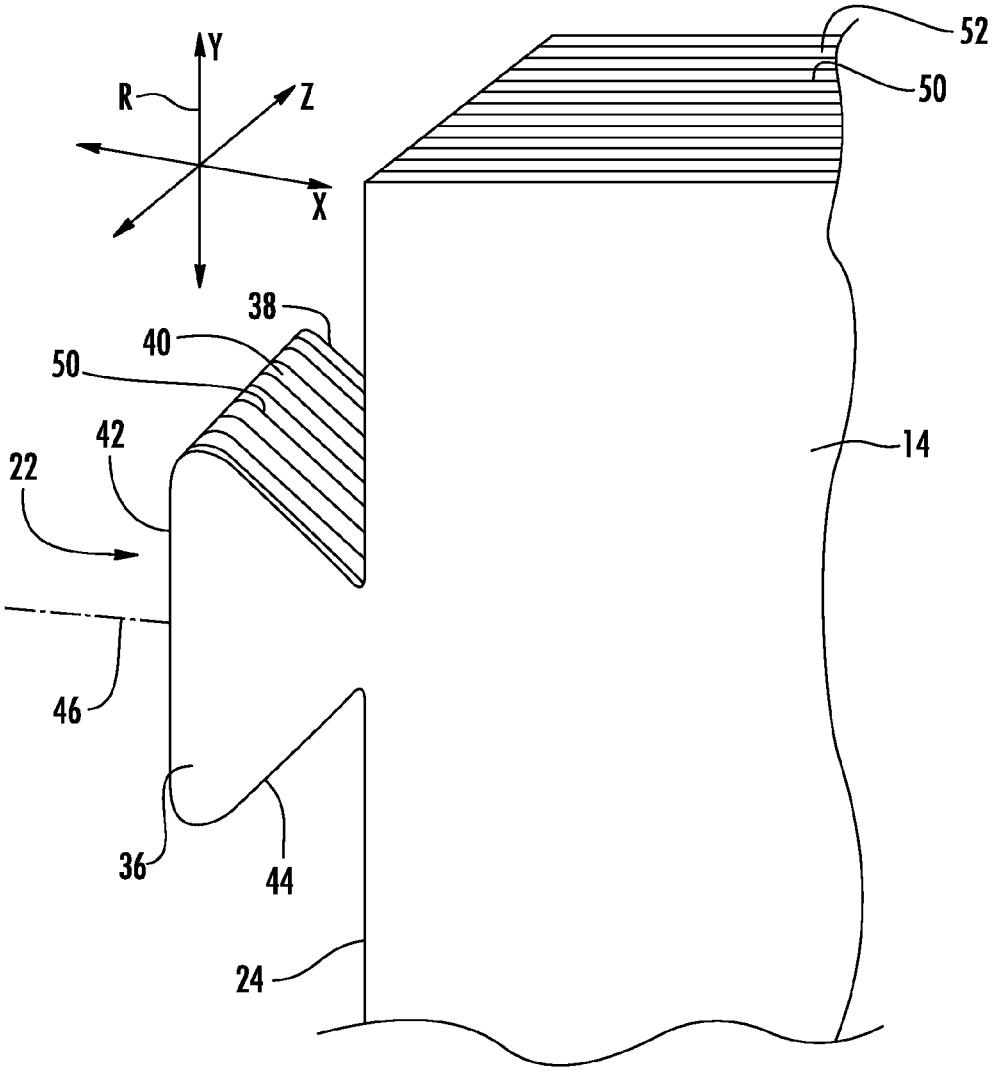
FIG. 4 is a perspective view of a male dovetail protrusion on a casting core piece formed in accordance with aspects of the invention, showing a plurality of protruding undercuts on various surfaces of the second casting core piece.

The male dovetails 22 can have a first side face 36 and a second side face 38 (see FIGS. 2 and 4). The first side face 36 and the second side face 38 can be generally planar. The first side face 36 and the second side face 38 can be substantially parallel to each other. The male dovetails 22 can also have one or more thickness surfaces, including, for example, a first thickness surface 40, a second thickness surface 42 and a third thickness surface 44. Each male dovetail 22 can have an associated axis 46.

It should be noted that one or more of the surfaces of the male dovetails 22, such as thickness surfaces 40, 42 and/or 44 (FIGS. 2 and 4), can have one or more "protruding undercuts," as that term is described in U.S. Pat. Nos. 7,411,204; 7,410,606; and 7,141,812 and U.S. Patent Application Publication Nos. 2004/0156478 and 2008/0053638, each of which is incorporated in its entirety herein by reference. A protruding undercut can be a resultant feature of casting in the multi-layer mold used in the tomolithographic molding process. An example of a male dovetail 22 having protruding undercuts 50 is shown in FIG. 4. The protruding undercuts 50 can appear on other surfaces of the second core piece 14, including, for example, an upper end surface 52 and/or an engaging surface 24. The protruding undercuts 50 can provide numerous benefits, which will be described in greater detail below. It should be noted that, while formed by casting in a multi-layer mold, the second core piece 14 is itself a monolithic structure.

The male dovetails 22 can project from the engaging surface 24 on the second core piece 14. Apart from the male dovetails 22 and the protruding undercuts 50, the engaging surface 24 can otherwise be generally planar. When the second core piece 14 is a trailing edge core 16, the engaging surface 24 can be elongated in generally the radial direction R. The term radial direction is intended to mean generally radial to the turbine axis if such an airfoil were installed in its operational position in a turbine engine.

The male dovetails 22 can be oriented in any suitable manner. In one embodiment, the dovetails can be oriented so that the first and second core pieces 12, 14 can be brought together by bringing the first core piece 12 and/or the second core piece 14 together laterally, as is generally shown in FIG. 2.

Figure 5:
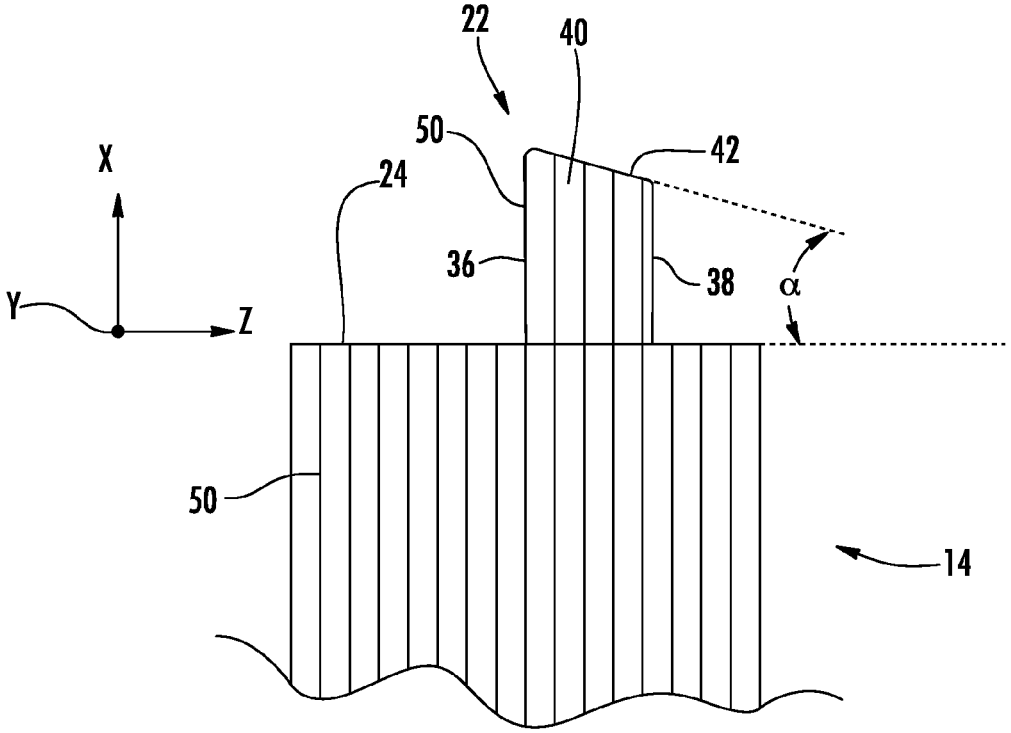
FIG. 5 is a top plan view of a casting core piece formed according to aspects of the invention, showing a male dovetail protrusion with a thickness surface that is angled relative to an engaging surface of the second casting core piece.

A Cartesian coordinate system with X-Y-Z axes can be applied to the second core piece 14 (see FIGS. 2 and 4-5). The engaging surface 24 of the second core piece 14 can be in a plane that is defined substantially by the Y-Z axes. The radial direction R can extend in a direction that is substantially parallel to the Y axis. The male dovetails 22 can project from the engaging surface 24 generally along the X axis. The first side surface 36 and the second side surface 38 can be in planes that can be defined substantially by the X-Y axes. In such case, the axis 46 of the male dovetail 22 can extend substantially in the direction of the X axis, as is shown in FIG. 4.

It should be noted that use of tomolithographic molding can permit a high degree of dimensional control and reliability. Thus, the male dovetails 22 can be provided so that each dovetail axis 46 extends at any suitable angle relative to the engagement surface 24 or to a plane substantially defined by the Y-Z axes. As shown in FIG. 4, the dovetail axis 46 can be at about 90 degrees relative to the engagement surface 24 or to a plane substantially defined by the Y-Z axes. However, the male dovetails 22 can be oriented so that the dovetail axis 46 is less than 90 degrees relative to the engagement surface 24 or to a plane substantially defined by the Y-Z axes.

Further, referring to FIG. 5, one or more of the thickness surfaces 40, 42, 44 can extend at almost any angle relative to the engaging surface 24 or to a plane substantially defined by the Y-Z axes. For instance, the second thickness surface 42 can extend at an angle a relative to the engaging surface 24 or to a plane substantially defined by the Y-Z axes. In one embodiment, the second thickness surface 42 can be angled at about 28 degrees relative to the engaging surface 24 or to a plane substantially defined by the Y-Z axes.

In the case of multiple male dovetails 22, the second thickness surface 42 of each dovetail 22 can all be at the same angle a relative to the engaging surface 24 or to a plane substantially defined by the Y-Z axes, or at least one of the dovetails 22 can have a second thickness surface 42 that extends at a different angle to the engaging surface 24 or to a plane substantially defined by the Y-Z axes.

The male dovetails 22 can be substantially aligned on the engaging surface 24 in the radial direction R or in the direction of the Y-axis. However, in one embodiment, at least one of the dovetails 22 can be offset from the other male dovetails 22, such as in the Z-direction (not shown).

The first core piece 12 can include an engaging surface 26. The engaging surface 26 can be substantially planar, and it can include an opening 28 for each female dovetail 20. The engaging surfaces 24, 26 can be configured for substantially mating engagement. The engaging surfaces 24, 26 can defined an interface 27 between the first and second core pieces 12, 14. The interface 27 can be located in any suitable location. In one embodiment, the interface 27 can be located in a region of normal resolution in the casting core 10.

The dovetails (referring to both the male dovetails 22 and female dovetails 20) can be spaced in any suitable manner. For instance, the dovetails can be equally spaced to spread load equally across entire part. However, the dovetails do not have to be equally spaced. The dovetails can be spaced as needed to provide support where needed and to avoid interference with any intricate detail. It will be appreciated that the male dovetails 22 can be placed on the second component 14 with a high degree of accuracy using a method effective to produce high resolution features and/or detail, such as tomolithographic molding. The male dovetails can be placed in substantially direct alignment with cross-overs 34 (FIG. 3) in the second core part 14 to provide strength to the male dovetail 22 and prevent distortion of the thin wall between the male dovetails 22. The cross-overs 34 can provide structural strength and can form cooling passages in the ultimate part being cast.

The first core part 12 and the second core part 14 can be brought together so that each male dovetail 22 is received in a respective female dovetail 20. The male dovetail 22 can interlockingly engage the female dovetail 20 so as to generally to restrain movement in at least two dimensions, such as in the X and Y directions. However, it should be noted that, when the second core piece 14 is made using tomolithographic molding or other process effective to produce high resolution features and/or detail, the second core piece 14 can be configured to provide additional engagement with the female dovetail 20. For instance, the protruding undercuts 50 can provide additional engagement with the female dovetail 20. Alternatively or in addition, male dovetails 22 with second thickness surfaces 42 that are angled relative to the engaging surface 24 or to a plane substantially defined by the Y-Z axes can provide a third directional component of engagement (including, for example, at least partially in the Z direction).

Thus, a system according to aspects of the invention can provide three dimensional interlocking engagement between the male and female dovetails 20, 22. Thus, it will be appreciated that the tomolithographic molding process can enhance the engageability and alignability of the first and second core pieces 12, 14. When assembled, the engaging surface 26 of the first core piece 12 can abut the engaging surface 24 of the second core piece 14.

The joining of the first and second core pieces 12, 14 can be done outside of a mold. That is, the first and second core pieces 12, 14 can be formed separately in their own dies or molds. The first and second core pieces 12, 14 can then be brought together and joined out of their respective dies/molds or any other die/mold. Because the joining process is not confined to a mold or die, it will be appreciated that greater flexibility in making the first and second core pieces 12, 14 and the core assembly 10 overall can be realized. The handling of the first and second core pieces 12, 14 outside of a die/mold can be facilitated by the use of a binder system in forming the first and second core pieces 12, 14. The details of such a binder system will be described later.

Figure 3:
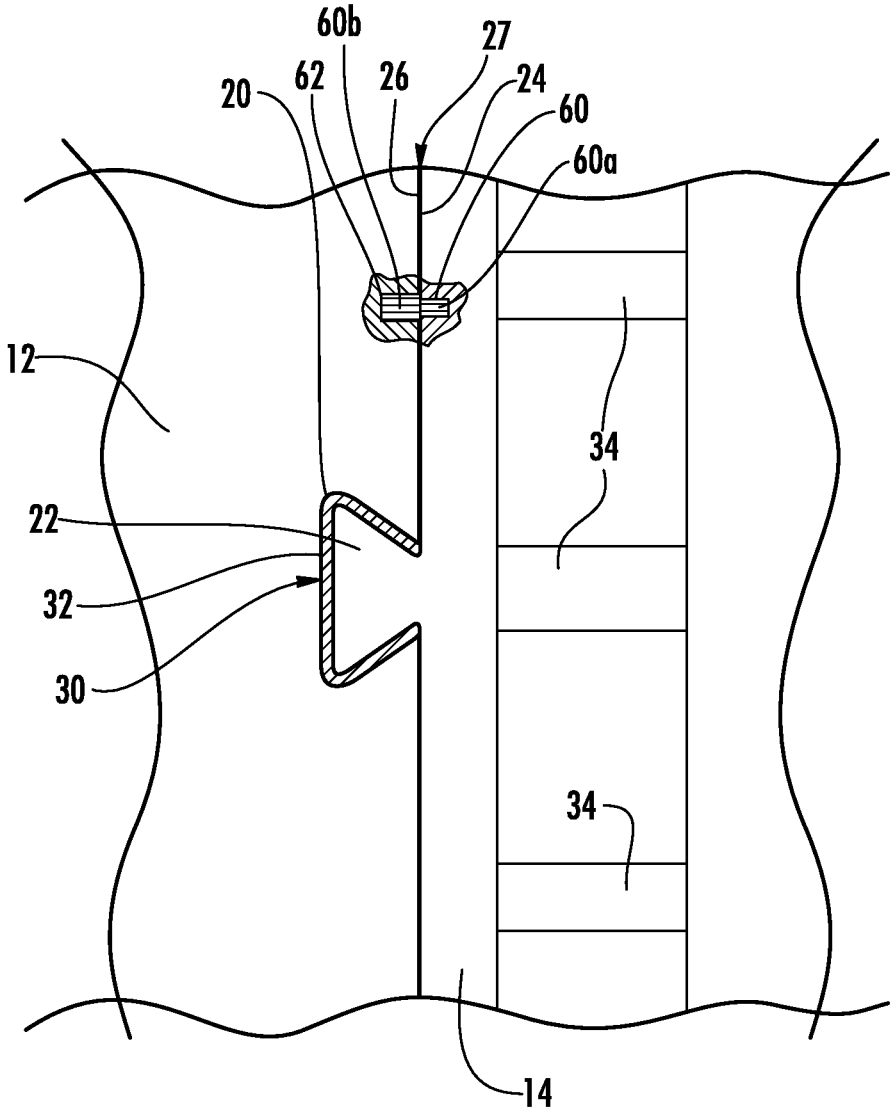
FIG. 3 is a close-up view of the interface between a female dovetail slot on a first casting core piece and a male dovetail protrusion on the second casting core piece according to aspects of the invention.

When the male dovetail 22 is received in the female dovetail 20, there may be a slight gap 30 between them, as shown in FIG. 3. The gap 30 can extend about at least a portion of the interface between the male dovetail 22 and the female dovetail 20. In one embodiment, the gap 30 can extend entirely about the interface between the male dovetail 22 and the female dovetail 20. The gap 30 can be about 0.005 inch. The gap 30 can be filled with an adhesive material.

When the first and second core pieces 12, 14 are made of a ceramic material, the adhesive material can be a fireable, ceramic material 32. The material 32 can be in the form of a slurry. This ceramic material 32 can be identical or substantially similar to the material of the first and/or second core pieces 12, 14. The ceramic material 32 can be selected so that its properties are identical or otherwise well-matched to the properties of the material of the first and second core pieces 12, 14 so that, when the joined core pieces 12, 14 are subsequently fired, the material properties of the core assembly 10 remain substantially constant throughout. In one embodiment, the ceramic material 32 can be substantially the same as the material of the second core piece 14. The joined first and second core pieces 12, 14 can then be fired together in a kiln or furnace to form the core assembly 10.

It will be appreciated that if one or more surfaces of the male dovetail 22 (such as thickness surfaces 40, 42, 44) have one or more protruding undercuts 50, then the ceramic material 32 will have additional surface area to adhere to, thereby potentially increasing the integrity and/or strength of the interface. Such additional surface area can lead to better green state binding and better high temperature sintering. Further, use of tomolithographic molding to form the second core piece 14 allows the male dovetails 22 to be selectively sized, shaped and oriented to minimize distortions due to core twist or core shift that may be experienced when the first and second core pieces are fired together.

The interface 27 between the engaging surfaces 24, 26 of the first and second core pieces 12, 14 can be strengthened in additional ways. For instance, a strengthening member can extend across the interface 27 and into each of the core pieces 12, 14. The strengthening member can be any suitable structure. In one embodiment, the strengthening member can be a foil 60. The foil 60 can be a very thin, often flexible sheet. The foil 60 can be composed of a single foil or a plurality of foils precisely aligned and/or bonded into a laminated, monolithic solid object. The individual foils 60 can be formed in any suitable manner, such as by chemical-machining or etching. The foil 60 can be formed of any suitable metal, such as, for example, Molybdenum, or any suitable alloy. The foil 60 can be made to give the desired strength and/or functionality in joining the core pieces 12, 14. The foil 60 can have any suitable size, shape and/or features to provide the desired properties at the interface 27. In one embodiment, the foil 60 can extend across the entire engaging surface 24 of the second core piece 14 generally in the Z-direction (FIG. 2).

The foil 60 can be provided in the core 10 in any suitable way. In one embodiment, a portion of the foil 60 can be embedded in the second core piece 14, as is shown in FIG. 3. To that end, the foil 60 can be inserted into the core mold/die, which can be a Tomolithographic mold/die. A ceramic slurry can be poured into the mold/die and around a portion of the foil 60. The slurry can be subsequently cured to form the second core piece 14. As a result, a portion 60*a* of the foil 60 can be embedded in the second core piece 14, and a portion 60*b* of the foil 60 can protrude from an exterior of the second core piece 14, such as the engaging surface 24. The protruding portion 60*b* of the foil 60 can be received in a recess 62 in the first core piece 12. The recess 62 can be formed in the first core piece 12 in any suitable manner. For instance, the recess 62 can be formed during the casting process or during a subsequent machining operation. In one embodiment, the recess 62 can be open on one of its ends to receive the foil 60 laterally.

When two core pieces (such as the first and second core pieces 12, 14) are brought together as described herein, the foil 60 can extend across an interface 27 defined therebetween (such as between engaging surfaces 24, 26). The protruding portion 60*b* of the foil 60 can help to accurately align the first and second core pieces 12, 14 during their assembly. When the first and second core pieces 12, 14 are joined, the foil 60 can extend into each of the core pieces 12, 14. As a result, the joint between the two core pieces 12, 14 can be fortified, which can improve the quality of the casting core 10. The foil 60 can be chemically leached out of or otherwise removed from the core 10 at a later point, if necessary.

The first and second core pieces 12, 14 can be brought together at different stages in their processing. For instance, the first core piece 12 and the second core piece 14 can be brought together when they are both fully fired or sintered. Alternatively, the first and second core pieces 12, 14 can be brought together when both are in a green state, that is, in a pre-fired or pre-sintered condition. In the green state, both the first and second core pieces 12, 14 have been cast and have hardened enough to enable each core piece 12, 14 to be removed from its respective mold, but they are not fully fired or sintered. Thus, it will be appreciated that the system and method according to aspects of the invention can allow increased flexibility in the mold design.

Typically, the strength of a conventionally-formed casting core in a green state is weak. As a result, it is difficult to transfer such core bodies out of a mold. Such transfer can be particularly difficult when such core bodies include one or more high resolution features or regions, as described herein. Core yields are low because cores can break when removed from a mold/die due to their fragile green body strength and or because their features are so small and complex. The addition of a binder can improve the strength of the green bodies to allow for handling and/or other beneficial properties.

Additional details of the binder system and the molding composition will now be provided. To prepare and/or provide a molding composition for at least partially filling the mold, a powder material can be combined with a binder system to form a molding composition, such as a slurry. The powder can comprise any of ceramic, silica, alumina, zirconia, silicon carbide, boron nitride, and/or yttria, etc. The powder, molding composition, and/or casting method can be any of those described herein, including any of those described in the following set of US patent documents, each of which is incorporated by reference herein in its entirety: U.S. Pat. No. 2,961,751 (titled "Ceramic Metal Casting Process"); U.S. Pat. No. 3,957,715 (titled "Casting of High Melting Point Metals and Cores Therefore"); U.S. Pat. No. 4,190,450 (titled "Ceramic Cores for Manufacturing Hollow Metal Castings"); U.S. Pat. No. 4,284,121 (titled "Process and Materials for Making Refractory Cores"); U.S. Pat. No. 4,837,187 (titled "Alumina-Based Core Containing Yttria"); U.S. Pat. No. 5,394,932 (titled "Multiple Part Cores for Investment Casting"); U.S. Pat. No. 6,588,484 (titled "Ceramic Casting Cores with Controlled Surface Textures"); U.S. Pat. No. 7,413,001 (titled "Synthetic Model Casting"); and US Patent Application Publication 2008/0169081 (titled "Method and Apparatus for Production of a Cast Component").

What follows are several examples of potential molding composition for parts, whose approximate composition can range as follows: Silica 10%-99%; alumina 1%-90%; cristobalite 1%-20%; zircon 1%-20%; magnesium oxide 0.01%-1.0%; silicone resin 1%-30%; organic binder 1%-30%.

Ceramic materials, such as those of the type described in U.S. Pat. No. 4,837,187, which is incorporated by reference herein in its entirety, can be used for the molding composition and/or in forming core parts of gas turbine engine blade cores by low pressure injection molding. Specifically, a molding composition with a composition of: approximately 1 wt % to approximately 90 wt % alumina, such as 84.5 wt % alumina; approximately 1 wt % yttria to approximately 20 wt % yttria, such as approximately 7.0 wt % yttria; approximately 0.05 wt % magnesia to approximately 10 wt % magnesia, such as 1.9 wt % magnesia; and/or approximately 1 wt % graphite (flour) to approximately 15 wt % graphite (flour), such as approximately 6.6 wt % graphite (flour) was found to perform acceptably in a two piece core construction. For example, an illustrative molding composition can comprise approximately 94 wt % of 200 mesh fused silica, approximately 6 wt % of 400 mesh Cristobalite, approximately 6 wt % of 325 mesh tabular alumina, and/or approximately 0.2% superfine MgO.

The alumina component of a produced exemplary embodiment of this molding composition included approximately 70.2% of approximately 37 micrometer sized grains, approximately 11.3% of approximately 5 micrometer grains, and approximately 3% of approximately 0.7 micrometer grains. The grain sizes of the other components were: graphite—approximately 17.5 micrometer; yttria—approximately 4 micrometer; and magnesia—approximately 4 micrometer. The thermoplastic binder used included the following components (wt % of mixture): OKERIN 1865Q (Astor Chemical); paraffin based wax approximately 14.41 wt %; DuPont ELVAX 310 FINNECAN, approximately 0.49 wt %; oleic acid—approximately 0.59 wt %.Other ceramic material components and thermoplastic binders could be used, including those set forth in U.S Pat. No. 4,837,187.

In certain exemplary embodiments of the molding composition, any of a wide variety of silicone resins can be used. For example, siloxanes of the type described in U.S. Pat. Nos. 3,090,691 and 3,108,985, each of which is incorporated by reference herein in its entirety, can be utilized, including any organic siloxane in which the substituent groups are hydrogen atoms or organic radicals attached directly to the silicone atoms. In general, siloxanes containing 1 to 3 hydrogen and/or organic substituents per silicon atom, and the organic group contains 1-12 carbon atoms, optionally substituted by a group containing an oxygen atom and/or a nitrogen atom can be utilized. As used herein, the term "siloxane" is intended to refer to and include a material which contains at least one linkage per molecule. In an exemplary embodiment, approximately 11 g to 19 g (including all values and subranges therebetween) of MOMENTIVE 355 silicone resin can be used with each 100 g of ceramic powder.

Certain exemplary embodiments of the molding composition can employ siloxane resins such as dimethyl siloxane, monomethyl siloxane, phenylmethyl siloxane, monophenyl siloxane, diphenyl siloxane, monethyl siloxane, ethylmethyl siloxane, diethyl siloxane, phenylethyl siloxane, monopropyl siloxane, ethylpropyl siloxane, divinyl siloxane, monovinyl siloxane, ethyl vinyl siloxane, phenyl vinyl siloxane, diallyl siloxane, monoallyl siloxane, allylethyl siloxane, allylvinyl siloxane, monocyclohexyl siloxane, gamma-hydroxypropylmethyl siloxane, beta-methoxyethylmethyl siloxane, gamma-carboxypropyl siloxane, gamma-aminopropyl siloxane, and/or gamma-cyanopropylmethyl siloxane, etc.

Certain exemplary embodiments of the molding composition can utilize any of a variety of filler materials of the type typically used in the preparation of molds and cast parts, such as the Group IVB metals, including refractory and/or ceramic materials, such as silica, alumina, and/or zircon, etc. As indicated above, the filler particles can be bonded together by a siliceous bond on firing of the preformed part as a result of partial decomposition of the siloxane resin. The bulk density, apparent density, apparent porosity, and/or other properties of the baked or fired part can be controlled by varying the relative proportions of the filler and/or siloxane resin, by varying the size distribution of the ceramic particles employed in the molding composition, and/or by adding to the molding composition graphite and/or wood flour which can burn-out on firing to increase the porosity of the part.

When silica is the primary filler, the baked and/or fired part can have a bulk density within the range of approximately 1 to approximately 3 g/ml, such as, for example, from approximately 1.4 to approximately 2.0 g/ml. This range can correspond to an apparent solid density of approximately 1.80 to approximately 2.50 g/ml and an apparent porosity of approximately 15 to approximately 35 percent. For this purpose, use can be made of filler material having particle sizes within the range of approximately 100 to approximately 400 mesh.

Graphite can be used as the filler material in combination with a silicone resin as described above for molding a preformed part configuration. On baking and firing, a carbon and/or graphite bond can be formed in addition to the siliceous bond to form the desired part having a minimum bulk density of approximately 1.2 g/ml, and a maximum of approximately 5 g/ml. Such graphite parts can be particularly useful in the production of intricately cored, precision cast titanium components.

In addition to the filler, silicone resin, and/or catalyst components, the molding composition can be formulated to include, if desired, a plasticizer for the silicone resin to improve its working characteristics during molding of the composition in the preparation of a pre-formed part. Any suitable plasticizer for silicone resins can be used, including, for example, paraffin waxes, styrene, phenol or low molecular weight phenolic resins, and/or fatty amines such as N,N'-distearyl ethylenediamine, etc. The amount of plasticizer in the molding composition can be varied from approximately 0 to approximately 7% by weight of the resin content of the molding composition.

Any of a number of additives, such as parting agents or lubricants can be added to the molding composition to improve the processing characteristics of the molding composition during molding in the preparation of the pre-formed core configuration. Representative materials include, for example, calcium stearate as well as other metal salts of fatty acids.

The molding composition can be formulated in accordance with well known mixing techniques, including dry blending, wet mixing, hot mixing, etc., and then molded in a conventional manner using conventional molding techniques, such as transfer molding, injection molding, and/or compression molding, etc. Molding parameters including pressures, die temperatures, compound temperatures, and/or cure times can vary depending somewhat on the configuration of the part being molded and/or the particular composition of the molding composition. Typical pressure ranges normally used for transfer or injection molding can be from approximately 100 psi to approximately 10,000 psig, and approximately 100 psig to approximately 5,000 psig for compression molding. Compound and/or die temperatures usually can range from approximately room temperature up to approximately 400° F. and/or can be timed from approximately 1 to approximately 10 minutes.

The distribution of the particles of the powder comprised by the molding composition can be controlled over the entire cast part and/or any portion thereof, such as, in the case of a core, the core body, trailing edge of the core, and/or leading edge of the core, etc.

The binder system can comprise one or more urethane and/or epoxy resins, one or more solvents and/or wetting agents, and/or one or more plasticizers, etc. Any of a variety of plasticizers can be used, including paraffin waxes, styrene, phenol or low molecular weight phenolic resins, and/or fatty amines such as N,N'-distearyl ethylenediamine, etc. Binder systems can be produced using acrylics such as, for example, PMMA acrylic powder, resins, 2 part epoxy systems and/or composites, and/or methacrylates such as butyl, lauryl, stearyl, isobutyl, hydroxethyl, hydroxpropyl, glycidyl and/or ethyl, etc.; thermoplastics, such as, for example, ABS, acetyl, acrylic, alkyd, flourothermoplastic, liquid crystal polymer, styrene acrylonitrile, polybutylene terephthalate, thermoplastic elastomer, polyketone, polypropylene, polyethylene, polystyrene, PVC, polyester, polyurethane, thermoplastic rubber, and/or polyamide, etc., thermo-sets, such as, for example, phenolic, vinyl ester, urea, and/or amelamine, etc.; and/or rubbers: such as, for example, elastomer, natural rubber, nitrile rubber, silicone rubber, acrylic rubber, neoprene, butyl rubber, flurosilicone, TFE, SBR, and/or styrene butadiene, etc. Certain exemplary embodiments can employ a cycloaliphatic thermal cure epoxy. For example, approximately 10 g to 20 g of WO32701-8 epoxy from Resinlab of Germantown, Wis. can be used per 100 g of total ceramic powder weight, blended according to the manufacturer's directions of A:B approximately equals 0.94:1.

Binder materials and/or components can be liquids that can be fully soluble in, and/or diluted using, various solvents such as MEK, acetone, heptane, and/or isopropyl alcohol, etc. In the case of MEK, solvent additions can range between 10-22 grams per 100 grams of total ceramic powder weight. In the case of acetone, solvent additions can range between 14 grams and 27 grams per 100 grams of total ceramic powder weight. In the case of isopropyl alcohol, solvent additions can range between 11-21 grams per 100 grams of total ceramic powder weight. The binder system can comprise any of those appropriate materials described herein, including any of those described in any of the patents incorporated herein.

It has been found that ceramic cores having the desired thermal stability at temperatures as high as approximately 2700° F. and above can be produced when the molding composition is formulated to replace all or at least part of the silica component with a crystalline phase of silica which can be identified as Cristobalite. When Cristobalite is present as a constituent of the molding composition in an amount greater than approximately 2.5%, but not greater than approximately 10% by weight, the high temperature stability of the ceramic core can be superior to that of a core in which the silica component is formed of amorphous fused silica or fused silica combinations with zircon and/or alumina as the ceramic component of the core.

The amount of Cristobalite in the core body, at the time that the molten metal is cast into the mold cavity, can be important. The quantity can be sufficient to achieve the desired improvement in high temperature stability without adversely affecting the strength of the core or the thermal shock properties. While beneficial use can be obtained when all of the silica is replaced with Cristobalite, it can be desirable to limit the maximum concentration in the fired core to approximately 35% by weight and/or approximately 5 to approximately 20% by weight Cristobalite in the fired core. The remainder of the core can be formulated with fused silica and/or fused silica and zircon, and/or fused silica, zircon and/or alumina, with binders such as organo silicone resins, such as described in the aforementioned U.S. Pat. No. 3,957,715. The presence of Cristobalite can be achieved by the direct addition of Cristobalite to the components making up the molding composition. For this purpose, Cristobalite can be used in finely divided form such as in the range of approximately 70 to approximately −325 mesh. The core can be formed by transfer molding technique using silicone resins as the binder.

The following example identifies the approximate ingredient ranges for the molding composition by weight: silica 10%-99%; alumina 1%-90%; cristobalite 1%-20%; zircon 1%-20%; magnesium oxide 0.01%-1.0%; silicone resin 1%-30%; organic binder 1%-30%. For example, a composition of fused silica (60%) and alumina (40%) can be used.

The above compositions can include additional ingredients such as calcium stearate as a lubricant, and/or a catalyst that can be in the form of finely divided magnesium oxide and/or benzoic acid in equal parts by weight, with the lubricant being present in an amount within the range of approximately 0.2 to approximately 2% by weight and the catalyst being present in an amount within the range of approximately 0.2 to approximately 2% by weight.

The binder can be partially and/or fully mixed using standard mixing techniques. For example, a kitchen mixer such as a food blender and/or a ceramic slurry mixer such as an approximately 1 horsepower Ross Dispersion Mixer, model 100 LC, can be used. Mixing times to disperse the binder and/or mix it into the powder can range from approximately 1 minute to approximately 24 hours. The binder can be partially and/or fully mixed with the powder prior to filling mold with the molding composition or directly in the mold. The mixing can occur via any known technique, including shear, vibration, centrifugal force, resonant mixing, static mixing, and/or rotational ball-milling, etc.

The slurry composition can comprise any desired wetting agent and/or alternate binder system, which can comprise poly-vinyl alcohol and poly-ethylene glycol.

Generally, the viscosities ranging from approximately 500 to approximately 10,000 cps of the powder, binder, and/or molding composition can be appropriate to allow them to flow into and/or fill the mold. The binder concentration (ranging from approximately 10 percent to approximately 20 percent binder to ceramic powder by weight) of the molding composition can be sufficiently low to facilitate burnout of the binder and/or allow for the sintering of the powder.

Adequate time can be allowed to vent and/or de-gas the filled mold and/or to cure and/or set the cast part in the mold. For example, the time for venting, de-gasing, and/or mold filling can range from approximately 1 minute to approximately 60 minutes. The cast part can be released from the mold after the binder has at least partially cross-linked and/or cured. The cure temperature of the binder can be compatible with the mold material. The cure temperature can range from approximately 90° F. to approximately 350° F. The cure time can range from approximately 15 minutes to approximately 24 hours. The binder can have compatible reversion properties that can allow the cured "green" state ceramic part to be heated and thermo-formed prior to binder burn-out and sintering. The thermoforming temperature is dependent on the initial cure temperature used to produce the green state ceramic core and the specific glass transition temperature (Tg) of the polymer binder. Manufacturers of resins, epoxies, urethanes and other organic polymers (binders) specify the Tg of their products on the materials properties data sheet. During sintering, the binder can burnout clean, leaving substantially no carbon to react with the investment casting material.

The mold can be configured to be closed before, during, and/or after filling. In certain exemplary embodiments, the mold can be configured as two or more mold portions that remain open during and/or after filling, which can potentially more easily vent air from the mold, de-gas solvent in the molding composition, de-mold the cast part, etc.

The mold can be filled via any known technique, such as gravity pouring, injection pressure, vacuum, and/or dispersion, etc. The mold can be overfilled to insure a proper fill. A vacuum can be used to assist with air venting and/or degassing.

During and/or after filling of the mold with the molding composition, its particles can be compacted, densified, and/or packed in a maximum density configuration to substantially eliminate gaps between ceramic particles, thereby helping the particles to sinter to each other during ceramic firing. That is, the location, size distribution, count, and/or packing density of the particles can be adjusted and/or controlled via applying energy, such as vibrational energy, to the mold during and/or after filling. As desired, adjustments can be made to the pre-vibration settling time (approximately 2 minutes to approximately 2 hours), vibration time (approximately 2 minutes to approximately 2 hours), the vibration frequency range and/or amplitude, post-vibration settling time (approximately 2 minutes to approximately 2 hours), and/or solvent separation time (approximately 2 minutes to approximately 2 hours), etc. A linear action Jogger table can be used at a power setting range of approximately 10% to approximately 90% to adjust the amplitude and at a frequency of approximately 250-5000, approximately 250-3600, and/or approximately 3600-5000 pulses per minute. While the mold is being vibrated, the mold can stay open to allow the solvent to more easily evaporate out of the molding composition. While the mold is being vibrated and/or while open, the mold can be heated (temperature range from approximately 100° F. to approximately 350° F. for approximately 15 minutes to approximately 24 hours) and/or cooled (temperature range from approximately 60° F. to approximately 80° F. for approximately 1 minute to approximately 3 hours) to affect molding composition flow, densification, and/or curing, etc.

In short, a binder system according to aspects of the invention can include three main ingredients—a resin, a solvent and a plasticizer. These three main ingredients can be selectively used in the binder to provide the desired properties in the green body core. For instance, a suitable epoxy resin can be selected to provide a desired work time.

The binder system according to aspects of the invention can provide significant benefits. For instance, it can produce cores with relatively high green body strength, improved yields, fine feature control and the ability to thermally form the green bodies. A strong green body is advantageous because it enables one to pull the core from a die/mold with substantially minimized risk of breakage. Further, a strong green body can allow the inclusion of fine and complex features that cannot otherwise be included with conventional core molds/dies. Such fine and complex features can be in provided in any plane and have non-traditional draft angles.

The binder system can also allow the green body to be thermally formed. If the green body is heated to a temperature above a certain curing temperature, then the green body goes into a state in which it becomes formable. In this state, the green body can be manipulated to correct defects or to provide corrections that may be necessary to compensate for warping that has occurred. Once the desired features are achieved, the final firing can occur in which the binder is burnt off and the particles are sintered together, thereby hardening the body into the final configuration. It should be noted that over or under compensations can be made in the green body to account for movements in the green body that may occur during firing or sintering. It will be recognized that the ability to thermally form a green body can have significant advantages over past practices.

Once it is completed, the core 10 can be used in casting the ultimate component. In the case of a turbine vane or blade, such casting can be done by investment casting. In such case, wax is injected onto the core 10 so that the core 10 is covered by wax. A ceramic shell can be formed over the wax. The wax can be melted out and molten metal can be poured in the space between the core 10 and the ceramic shell. Once the metal solidifies, the core 10 can be chemically leached out of the casting, leaving the desired internal features in the vane or blade. In the investment casting process, the core 10 formed in accordance with aspects of the invention is used only one time.

Figure 9A:
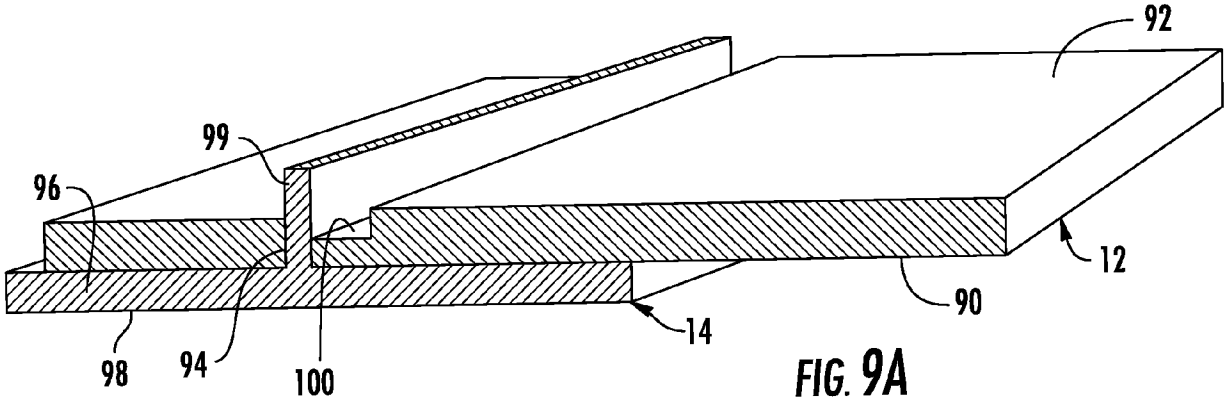
FIG. 9A is a perspective cross-sectional view of an alternative manner of joining a first core piece and a second core piece, showing a protrusion of the second core piece being received in a cavity in the first core piece and extending beyond an outer side of the first core piece.
Figure 9B:
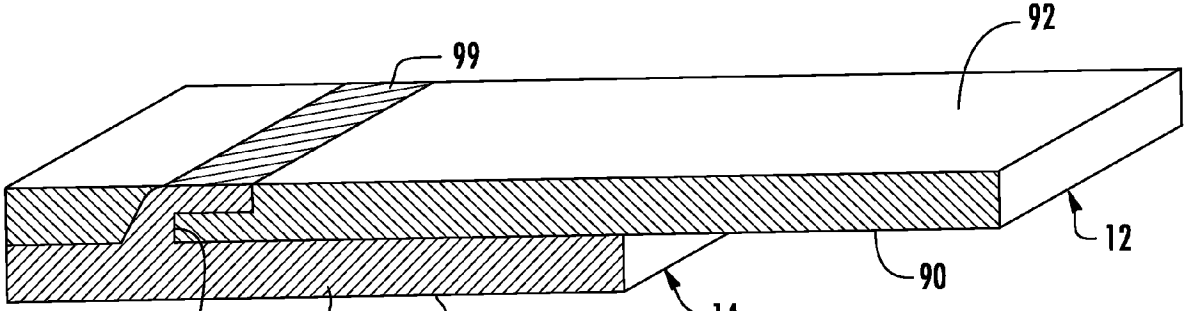
FIG. 9B is a perspective cross-sectional view of the alternative manner of joining the first core piece and the second core piece, showing the protrusion of the second core piece being folded over on the first core piece to thereby bring the first and second core pieces into interlocking engagement according to aspects of the invention.

As noted above, additional forms of interlocking engagement are possible. FIGS. 9A and 9B show another example of a way in which interlocking engagement between the first and second core pieces 12, 14 can be achieved. The first core piece 12 can have an inner side 90 and an outer side 92. While the first core 12 piece is shown as being generally rectangular in FIGS. 9A and 9B, embodiments of the invention are not limited to any particular shape or configuration. A cavity 94 can extend through the first core piece 12 from the inner side 90 to the outer side 92. The cavity 94 can have any suitable size, shape and orientation. In one embodiment, the cavity 94 can be generally rectangular, as is shown in FIGS. 9A and 9B.

The second core piece 14 can have an inner side 96 and an outer side 98. While the second core piece 14 is shown as being generally rectangular in FIGS. 9A and 9B, embodiments of the invention are not limited to any particular shape or configuration. The second core piece 14 can include a protrusion 99. The protrusion 99 is shown in FIG. 9A as being generally rectangular, but it can have any suitable configuration. At least a portion of the protrusion 99 can be configured to be received within the cavity 94.

The protrusion 99 can be sufficiently long such that a portion of the protrusion 99 extends beyond the outer side of the first core piece 12, as is shown in FIG. 9A. Heat can be applied to at least a portion of the protrusion 99 and/or the second core piece 14 to achieve the preferred flow, formability or other properties of the binder when the second core piece 14 is in the green state. In some instances, localized portions of the protrusion 99 and/or the second core piece 14 can be heated to achieve the preferred flow, formability or other properties of the binder without affecting the rest of the second core piece 14. The second core piece 14 can then be manipulated or formed such that the protrusion 99 is folded over onto the first core piece 12, such as onto the outer side 92. In this way, the first and second core pieces 12, 14 can be maintained in interlocking engagement. The joined first and second core pieces 12, 14 can be fired together in a kiln or furnace to form a core assembly.

In some instances, a recess 100 can be formed in the first core piece 12. The recess 100 can open to the outer side 92 of the first core piece 12. The recess 100 can be sized and shaped to receive the folded over portion of the protrusion 99. As a result, the protrusion 99 can be substantially flush with the outer side 92 of the first core piece 12, as is shown in FIG. 9B.

Figure 10A:
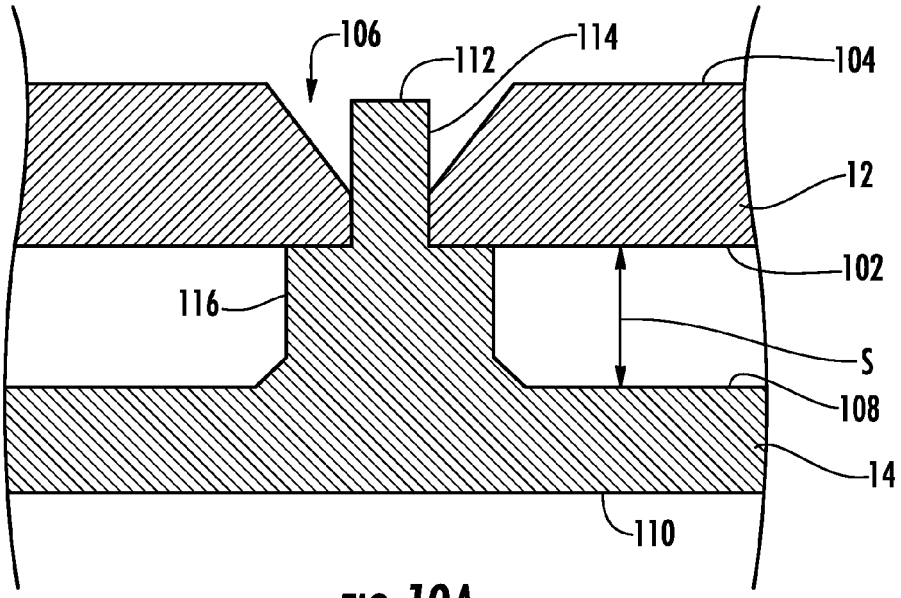
FIG. 10A is a side elevation cross-sectional view of an alternative manner of joining a first core piece and a second core piece, showing a protrusion of the second core piece with a first region that is received in a cavity in the first core piece and with a second region that is larger than the cavity so as to fix the distance between the first and second core pieces.
Figure 10B:
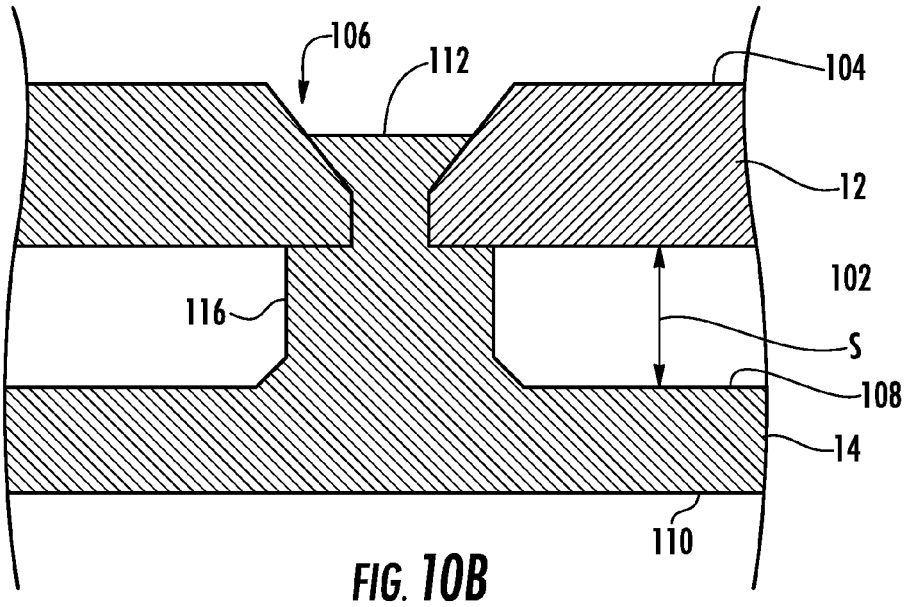
FIG. 10B is a side elevation cross-sectional view of the alternative manner of joining the first core piece and the second core piece, showing the protrusion of the second core piece being locally formed within the cavity to thereby bring the first and second core pieces into interlocking engagement according to aspects of the invention.

FIGS. 10A and 10B show yet another possible manner of forming an interlocking engagement between the first and second core pieces 12, 14. The first core piece 12 can have an inner side 102 and an outer side 104. The first core piece 12 is shown as being generally rectangular in FIGS. 10A and 10B, but embodiments of the invention are not limited to any particular shape or configuration for the first core piece 12. A cavity 106 can extend through the first core piece 12 from the inner side 102 to the outer side 104. The cavity 106 can have any suitable size, shape and orientation. In one embodiment, the cavity 106 can be generally conical, expanding in diameter when moving from the inner side 102 to the outer side 104, as is shown in FIGS. 10A and 10B.

The second core piece 14 can have an inner side 108 and an outer side 110. The second core piece 14 is shown as being generally rectangular in FIGS. 10A and 10B; however, embodiments of the invention are not limited to any particular shape or configuration of the second core piece 14. The second core piece 14 can include a protrusion 112. At least a portion of the protrusion 112 can be configured to be received within the cavity 106.

Once at least a portion of the protrusion 112 is received in the cavity 106, at least a portion of the protrusion 112 and/or the second core piece 14 can be heated to achieve the preferred flow, formability or other properties of the binder when the second core piece 14 is in the green state. In some instance, localized portions of the protrusion 112 and/or the second core piece 14 can be heated to achieve the preferred flow, formability or other properties of the binder without affecting the rest of the second core piece 14. In such condition, the second core piece 14 can be formed to bring the first and second core pieces 12, 14 into interlocking engagement. For example, the protrusion 112 can be formed to correspond to at least a portion of the cavity 106, as is shown in FIG. 10B. In one embodiment, the protrusion 112 can be formed to fill the entire cavity 106. One the protrusion 112 is formed into the desired configuration, the first and second pieces 12, 14 can be interlockingly engaged. The joined first and second core pieces 12, 14 can fired together in a kiln or furnace to form a core assembly.

In some instances, the protrusion 112 and/or the cavity 106 can be configured to maintain a desired spacing S between the inner surface 102 of the first core piece 12 and the inner surface 108 of the second core piece 14. For example, the protrusion 112 can include a first portion 114 and a second portion 116. The first portion 114 can be sized and shaped to be received in the cavity 106. The second portion 116 can be sized, shaped and/or otherwise configured to ensure that the second portion 116 is not received in the cavity 106. For example, when the cavity 106 and the protrusion 112 are generally circular in cross-sectional shape, the diameter of the second portion 116 of the protrusion 112 can be greater than the diameter of the cavity 106. In this way, the distance between the first and second core pieces 14, 16 can be fixed and maintained during assembly as well as during firing.

It should be noted that systems and methods according to aspects of the invention can be applied to provide benefits in connection with other portions of the molding and/or investment casting side casting process. For example, systems and methods according to aspects of the invention can be applied in connection with core prints and/or core locks associated with the core 10. Generally, core prints can hold and align the core in the mold/die during wax injection, and core locks can locate and hold a core and/or ceramic shell during casting of the component. Core prints and core locks typically extend beyond the footprint of the part being cast and do not form a part of the final cast component. An example of a casting core 10 having core prints and core locks in accordance with aspects of the invention in shown in FIG. 7. The core 10 shown includes two core prints 70, one at each end of the core 10. A core lock 72 can be formed on one of the core prints 70. The core prints 70 and the core locks 72 can be provided in any suitable location. The core locks 72 can be any suitable size and shape. The casting core is shown in phantom because it can have any suitable configuration.

Aspects of the invention can allow greater flexibility in making core prints and core locks. For instance, the core prints can be formed together with the core pieces. Alternatively, the core prints can be formed separately from the core pieces. When the core prints are formed separately, they can be subsequently joined to one or more of the core pieces using any of the joining techniques for two core pieces, as described herein. Thus, the core pieces and the core prints can include one or more features to align the pieces in a precision way, thereby enhancing the manufacturability of the core.

In one embodiment, the core prints can include recesses and the core pieces can include protrusions adapted for interlocking engagement with the recesses. Any suitable type of interlocking engagement can be used, including any of those described herein in connection with the joining to two core pieces. These features allow for better alignment between the separately formed core prints and the core pieces, which, in turn, will lead to better alignment and functionality in subsequent stages in the casting process. It will be appreciated that the opposite arrangement can be provided in which the core prints include protrusions adapted for interlocking engagement with recesses in the core pieces. Still alternatively, the core prints can include both protrusions and recesses adapted for interlocking engagement with corresponding recesses and protrusions on the core pieces.

The core prints are relatively large structures that are of normal resolution; that is, they typically do not include any special features or geometries. Thus, the methods of forming high resolution regions in the core may not be suitable for the formation of the core prints. By forming the core prints separately from the core pieces, it will be appreciated that forming holding structures can provide a previously unavailable degree of freedom. For instance, greater flexibility is allowed in the manipulation of the core pieces and the core prints. In addition, because the separately formed parts can be later aligned and joined in a high precision way, a greater range of options becomes available for the shape and the location of the core prints. Likewise, there are more options available for the shape and location of the core locks.

In light of the above, it will be appreciated that aspects of invention can provide a robust system and method for forming a casting core. The system and method according to aspects of the invention can reduce the core development process, which, in turn, can reduce the time to market for new product developments. Further, because the core pieces with the most complex, critical and/or intricate features can be made using a process that offers a high degree of geometric and dimensional control, the amount of scrap castings can be reduced.

It should be noted that, while a portion of the above description has been directed to a core made of two core pieces, it will be understood that aspects of the invention can readily be applied to cores that are made of more than two pieces. For instance, a third core piece (not shown) that is made using conventional casting techniques can be joined to the first core piece 12 in any conventional manner, or it can be joined to the second core piece 14 in any of the manners described above, such as by interlocking engagement. If the third core piece is made using a method effective to produce high resolution features and/or detail, then it can be joined to the first core piece 12 by interlocking engagement or in any of the manners described above, or it can be joined to the second core piece 14 in any suitable manner. Again, there can be any number of core pieces.

Figure 8:
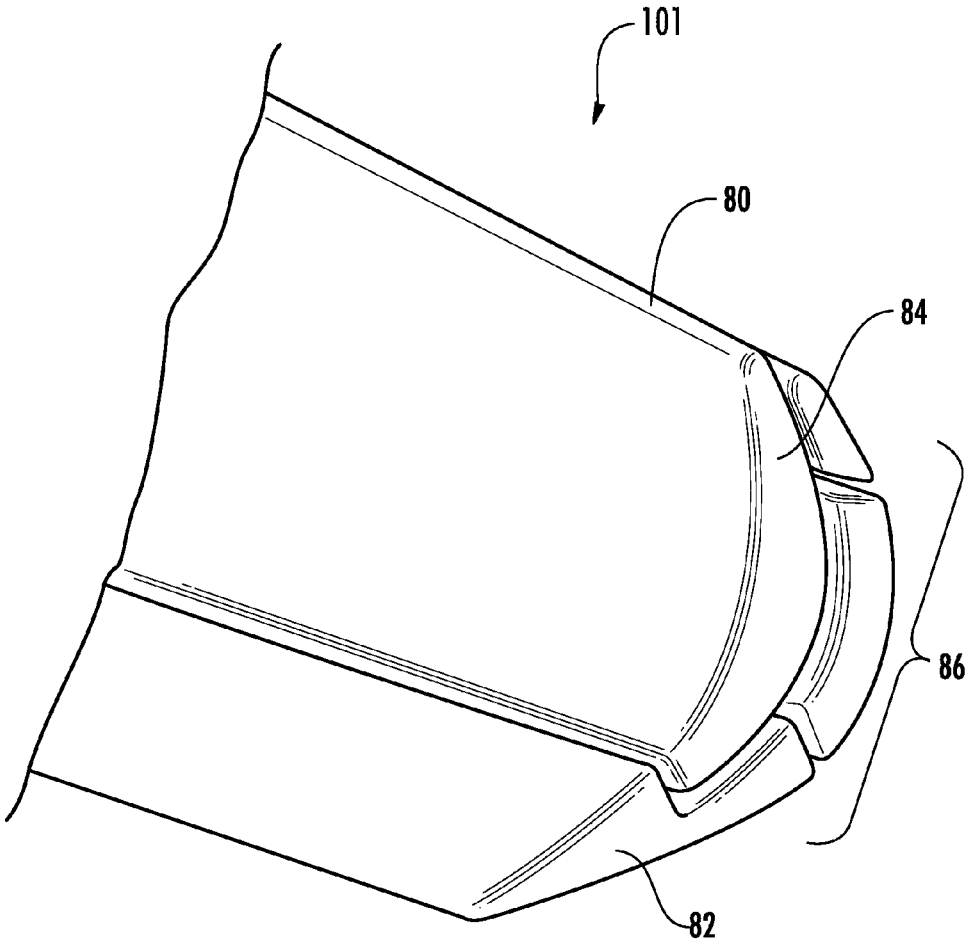
FIG. 8 is a perspective view of a portion of a multi-wall casting core formed in accordance with aspects of the invention.

In addition to forming multi-piece structures, systems and methods according to aspects of the invention can be used to produce multi-wall cores. The term "multi-wall" means a core with a plurality of closely-positioned walls. One example of a multi-wall core 101 according to aspects of the invention is shown in FIG. 8. The multi-wall core 101 includes a first core piece 80 and a second core piece 82. The first core piece can include a first wall 84, and the second core piece 82 can include a second wall 86. Each wall can comprise a single wall, as in the case of the first wall 84, or a plurality of walls, as in the case of the second wall 86. The first and second walls 84, 86 can include high resolution features or regions. In some instances, one or both walls 84, 86 may be of normal resolution.

The spacing between two neighboring walls may or may not be substantially constant. Neighboring walls in a multi-wall core may be generally complimentary to each other. It should be noted that, while the term "wall" may connote a planar structure, embodiments of the invention are not so limited, as the walls can have any of a number of non-planar features, including curves, bends, compound surfaces, protrusions and recesses, just to name a few possibilities. The walls can be relatively thin.

While the example multi-wall core 101 in FIG. 8 shows has two walls 84, 86, it will be understood that there can be more than two walls. Further, while the multi-wall core 101 includes a first core piece 80 and a second core piece 82, the multi-wall core 101 can be formed together as a single piece structure. Alternatively, each wall can be defined by separately formed core pieces 80, 82, and the core pieces 80, 82 can be brought together in any suitable manner. The separate core pieces 80, 82 can be joined together in any suitable location. For instance, the core pieces 80, 82 can be joined at one or more of their ends regions. The core pieces 80, 82 can be directly connected together in any of the manners described herein, or they can be indirectly connected, such as by a core print. Alternatively or in addition, there can be interconnections between neighboring walls in or more locations along their length. Any suitable form of interconnection can be made, including, for example, any of those described above in connection with joining two or more separate core pieces.

It will be appreciated that, if the core includes a plurality of walls, the overall surface area of the core can be increased, thereby allowing more features that can affect the heat transfer properties of the ultimate part. Further, by providing more internal features in the component being cast, an overall decrease in weight can be realized over conventional component designs. Moreover, the internal features can collectively increase the strength of the component.

It will be readily appreciated that a multi-wall core as described herein is not attainable using conventional core formation techniques. In some instances, a multi-wall core can be formed using a method effective to produce high resolution features, such as tomo lithographic molding and including any of the techniques and systems described herein. Multi-walled cores according to aspects of the invention may or may not have high resolution features. A multi-wall structure can be effective to produce high efficiency cooling features in the component being cast.

It should also be noted that, in some instances, glass or quartz rods are used as connecting members to join multiple casting core pieces when the assembly is fired or sintered. It will be readily appreciated that such practice can be eliminated by systems and methods for joining casting core pieces as described herein. Alternatively, systems and methods for joining casting core pieces according to aspects of the invention can be used to optimize the use of glass and quartz rods in joining casting core pieces.

Other embodiments of interlocking engagement between the first and second core pieces 12, 14, as shown in FIGS. 11-18, may be used to irreversibly interlock first and second core pieces 12, 14 together by thermal deformation to create a three dimensional interlocking joint. In at least one embodiment, the first and second core pieces 12, 14 may be used to form at least a portion of a turbine airfoil for a gas turbine engine, such as, but not, limited to a turbine blade. The first core piece 12 may be formed from a normal resolution region 120 of the core 122 using a first process of molding. The second core piece 14 may be formed from a high resolution region 124 of the core 122 using lithographic molding, which is a method of molding different than the first process and effective to produce high resolution features. The high resolution region 124 may have one or more high resolution features selected from the group consisting of a recess, cavity, opening, protrusion, channel, groove, slot, and depression. The first core piece 12 may include a cavity 126, and the second core piece 14 may include a protrusion 128. The first and second core pieces 12, 14 may be joined such that a first portion 130 of the protrusion 128 is received in at least a portion of the cavity 126. The protrusion 128 may be heated via an intermediate thermal heat treatment process causing the protrusion 128 to thermally deform to create a three dimensional interlocking joint 132 between the first and second core pieces 12, 14 by allowing thermal creep to irreversibly interlock the first and second core pieces 12, 14 together such that the joint 132 becomes physically locked together providing joint stability through thermal processing. The protrusion 128 may be heated via an intermediate thermal heat treatment process to a temperature above 1100 degrees Celsius for up to about 10 hours to produce the desired cristobalite structure.

Figure 11:
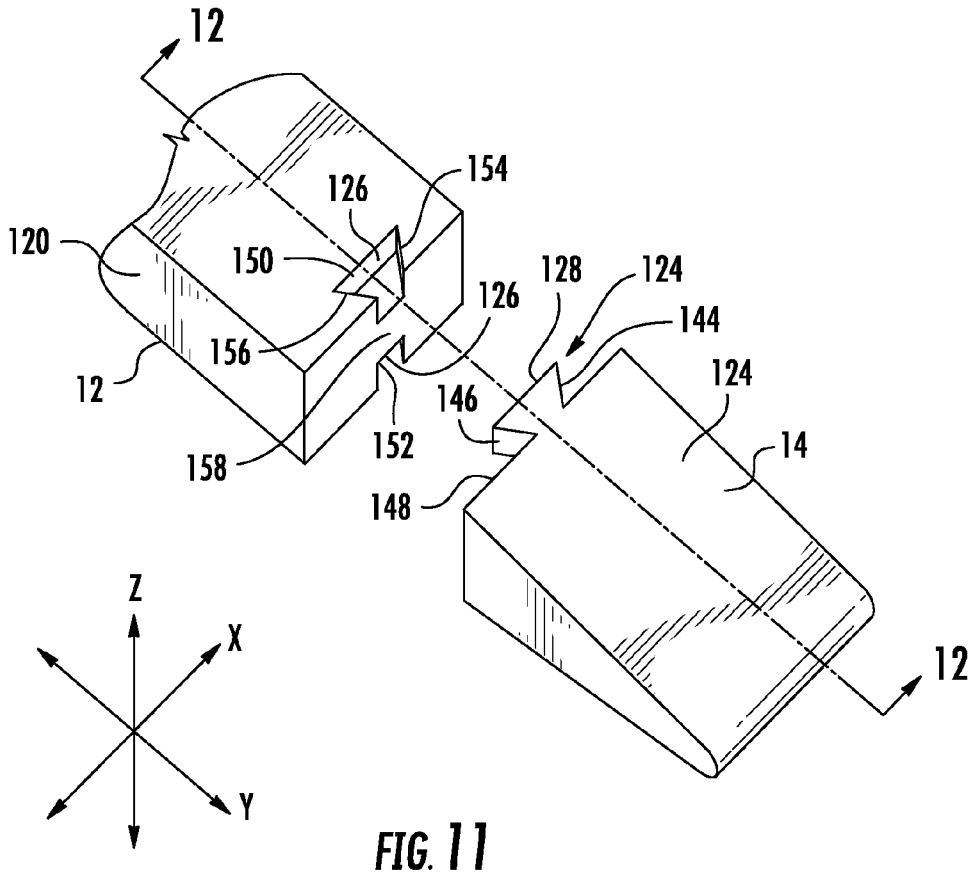
FIG. 11 is a perspective view of an alternative configuration of the first core piece and the second core piece whereby the second core piece includes a protrusion formed from first and second protrusions extending from the second core piece at acute angles forming a dovetail shape on each protrusion.
Figure 12:
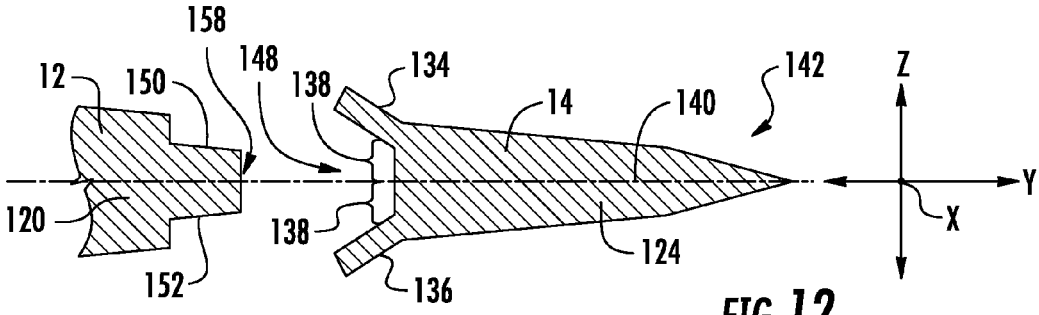
FIG. 12 is a cross-sectional side view of the alternative configuration of FIG. 11 show in an exploded view before the first and second core pieces are attached together, as shown at section line 12-12 in FIG. 11.
Figure 13:
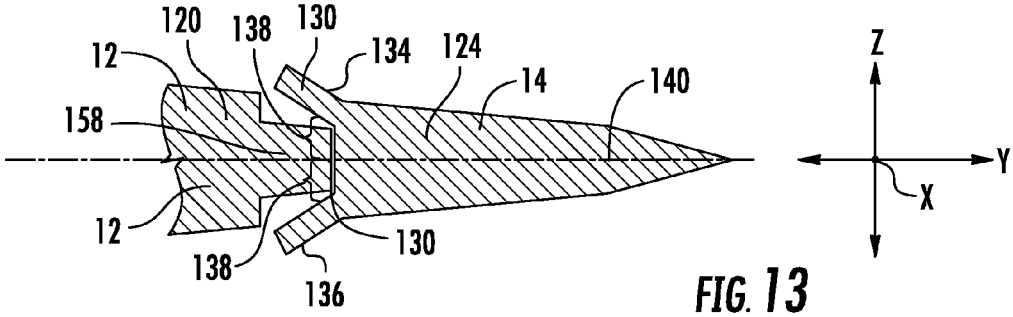
FIG. 13 is a cross-sectional side view of the alternative configuration of FIG. 11 show in an exploded view when the first core piece has been placed in contact with the second core piece but before the first and second core pieces are attached together.
Figure 14:
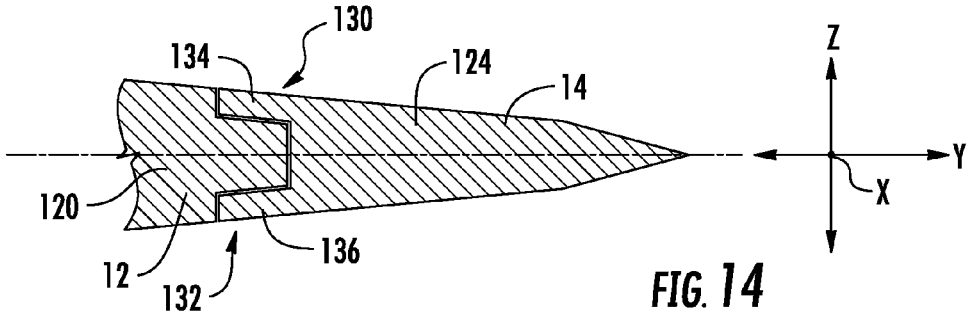
FIG. 14 is a cross-sectional side view of the alternative configuration of FIG. 11 show in an exploded view when the first core piece has been placed in contact with the second core piece but before the first and second core pieces are attached together.
Figure 15:
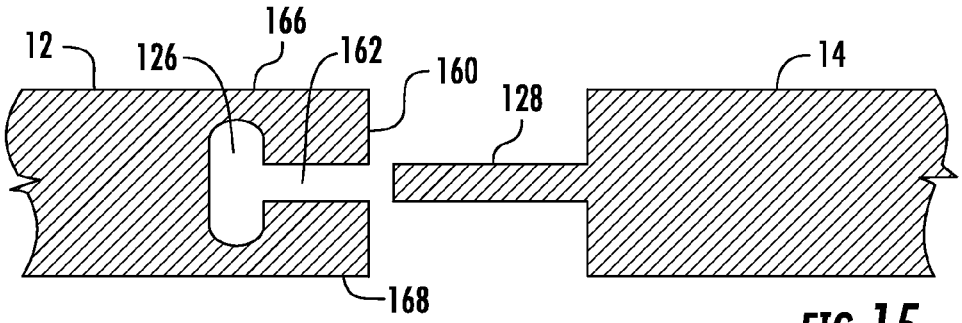
FIG. 15 is a cross-sectional side view of an alternative configuration of the first core piece and the second core piece whereby the first core piece includes a cavity therein and the second core piece includes a protrusion formed extending from the second core piece to be inserted within the cavity and thermally deformed to create a three dimensional interlocking joint.
Figure 16:
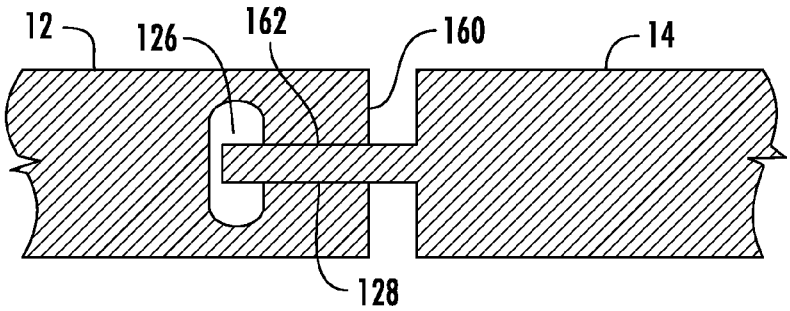
FIG. 16 is a cross-sectional side view of the protrusion from the second core piece shown in FIG. 15 inserted into the cavity of the first core piece.
Figure 17:
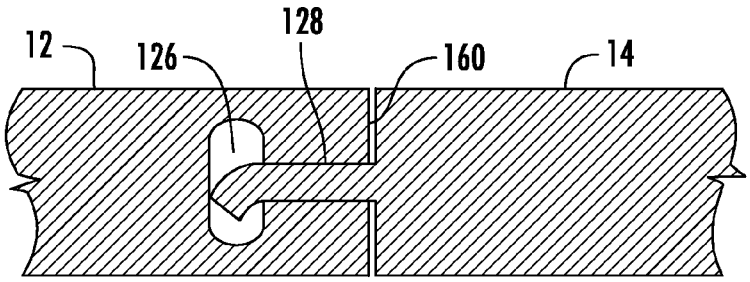
FIG. 17 is a cross-sectional side view of the protrusion from the second core piece shown in FIG. 15 inserted into the cavity of the first core piece and thermally deformed to create a three dimensional interlocking joint.

As shown in FIGS. 11-14, the protrusion 128 may be formed from first and second protrusions 134 and 136 extending from the second core piece 14 at acute angles 138 relative to a longitudinal axis 140 in a first perspective 142, which may be the Z-Y plane. The first perspective may be orthogonal to a plane defined by the X-Y plane, as shown in FIGS. 11-13. In addition, as shown in FIG. 11, the first protrusion 134 may have a dovetail shape with outer sidewalls 144, 146 extending axially away from each other at acute angles 138 from the longitudinal axis 140 in a second perspective in the X-Y plane, which is 90 degrees to the first perspective defined in the Z-Y plane. The first and second protrusions 134, 136 may be separated by open space 148 positioned therebetween. The cavity 126 in the first core piece 12 may include first and second cavities 150, 152 formed to receive the first and second protrusions 134, 136. The first cavity 150 may have dovetail shaped sidewalls 154, 156 and may be sized to receive the first protrusion 134 once the first protrusion 134 is subjected to the intermediate thermal heat treatment process and thermally deforms into position in the first cavity 150 forming the irreversibly interlocked joint 132, whereby a portion 158 of the first core piece 12 separates the first cavity 150 from the second cavity 152. The second protrusion 136 may have a dovetail shape with outer sidewalls 144, 146 extending axially away from each other at acute angles 138 from the longitudinal axis 140 in a second perspective in a X-Y plane that is 90 degrees to the first perspective in the Z-Y plane. The second cavity 152 may have dovetail shaped sidewalls 154, 156 and may be sized to receive the second protrusion 136 once the second protrusion 136 is subjected to the intermediate thermal heat treatment process and thermally deforms into position in the second cavity 152 forming the irreversibly interlocked joint 132.

Figure 18:
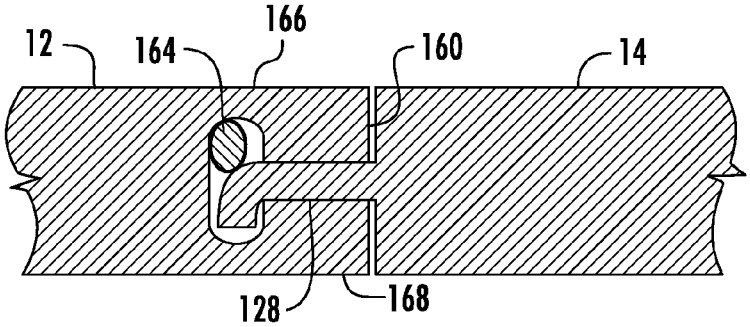
FIG. 18. is a cross-sectional side view of the protrusion from the second core piece shown in FIG. 15 inserted into the cavity of the first core piece and thermally deformed to create a three dimensional interlocking joint together with a locking member positioned in the cavity housing the protrusion in at least a portion of space in the cavity which was vacated by the protrusion once the protrusion was thermally deformed during the intermediate thermal heat treatment process.
Figure 10A:
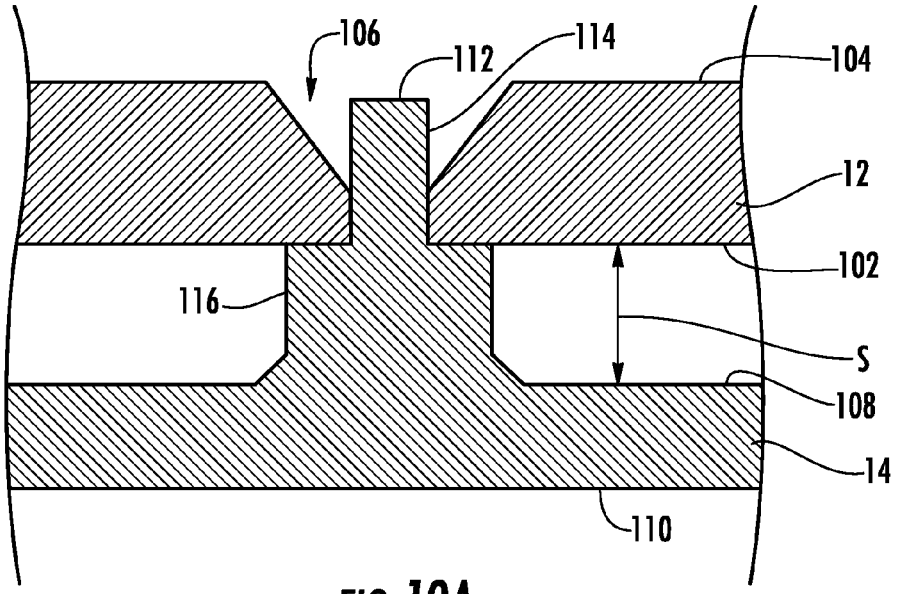
Figure 10B:
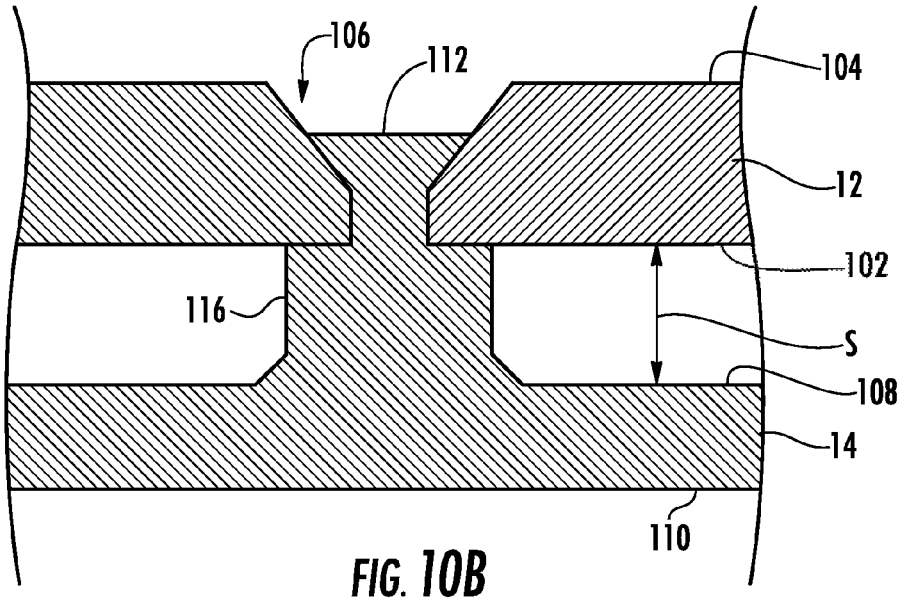

The protrusion 128 may form a tongue in groove joint, as shown in FIGS. 15-18 that after being subject to the intermediate thermal heat treatment process forms an irreversibly interlocked joint 132. The cavity 126 may be sized to receive the protrusion 128 and to enable the protrusion 128 to thermally deform during an intermediate thermal heat treatment process. The cavity 126 may be offset from a lateral contact surface 160 such that the cavity 126 may be exposed through the first core piece 12 via a neck 162 having a cross-sectional area that is less than the cavity 126. The first and second core pieces 12, 14 may be in a green state when the first and second core pieces 12, 14 are joined such that the first portion 130 of the protrusion 128 is received in at least a portion of the cavity 126. As such, when the protrusion 128 is thermally deformed during an intermediate thermal heat treatment process, the protrusion may not be removed from the cavity 126, thereby keeping the first and second core pieces 12, 14 attached to each other. As shown in FIG. 18, a locking member 164 may be inserted into the cavity 126 housing the protrusion 128 and into at least a portion of space in the cavity 126 which was vacated by the protrusion 128 once the protrusion 128 was thermally deformed during the intermediate thermal heat treatment process. The neck 162 may also be offset relative to the cavity 126 such that the neck 162 is closer to a first outer surface 166 of the first core piece 12 than a second outer surface 168. In at least one embodiment, the first and second core pieces 12, 14 may be configured such that the first portion 130 of the protrusion 128 is received in at least a portion of the cavity 126 comprises joining first and second core pieces 12, 14 outside of a mold.

The foregoing description is provided in the context of one possible application for the system and method according to aspects of the invention. While the above description is made in the context of casting a turbine blade or vane, it will be understood that the system according to aspects of the invention can be readily applied to any hollow cast turbine engine component, especially those with complex internal features. Thus, it will of course be understood that the invention is not limited to the specific details described herein, which are given by way of example only, and that various modifications and alterations are possible within the scope of the invention as defined in the following claims.

What is claimed is:

1. A method of forming a core for use in casting a turbine engine component comprising:

forming a normal resolution region of the core using a first process of molding; and forming a high resolution region of the core using lithographic molding, which is a method of molding different than the first process and effective to produce high resolution features;

wherein the high resolution region has one or more high resolution features selected from the group consisting of a recess, cavity, opening, protrusion, channel, groove, slot, and depression;

wherein the normal resolution region is defined by a first core piece and the high resolution region is defined by a second core piece;

wherein the first core piece includes a cavity therein;

wherein the second core piece includes a protrusion, joining the first and second core pieces such that a first portion of the protrusion is received in at least a portion of the cavity;

heating the protrusion via an intermediate thermal heat treatment process causing the protrusion to thermally deform to create a three dimensional interlocking joint between the first and second core pieces by allowing thermal creep to irreversibly interlock the first and second core pieces together such that the joint becomes physically locked together providing joint stability through thermal processing;

wherein the cavity is offset from a lateral contact surface such that the cavity is exposed through the first core piece via a neck having a cross-sectional area that is less than the cavity; and inserting a locking member into the cavity housing the protrusion and into at least a portion of space in the cavity which was vacated by the protrusion once the protrusion was thermally deformed during the intermediate thermal heat treatment process.

2. The method of claim 1, wherein the protrusion forms a tongue in groove joint that after being subject to the intermediate thermal heat treatment process forms an irreversibly interlocked joint.

3. The method of claim 1, wherein the neck is offset relative to the cavity such that the neck is closer to an outer surface of the first core piece than another outer surface.

4. The method of claim 1, wherein the protrusion is formed from first and second protrusions extending from the second core piece at acute angles relative to a longitudinal axis in a first perspective, wherein the first protrusion has a dovetail shape with outer sidewalls extending axially away from each other at acute angles from the longitudinal axis in a second perspective 90 degrees to the first perspective, wherein the first and second protrusions are separated by open space positioned therebetween, wherein the cavity in the first core piece comprises first and second cavities formed to receive the first and second protrusions, wherein the first cavity has dovetail shaped sidewalls and is sized to receive the first protrusion once the first protrusion is subjected to the intermediate thermal heat treatment process and thermally deforms into position in the first cavity forming the irreversibly interlocked joint, wherein a portion of the first core piece separates the first cavity from the second cavity.

5. The method of claim 4, wherein the second protrusion has a dovetail shape with outer sidewalls extending axially away from each other at acute angles from the longitudinal axis in a second perspective 90 degrees to the first perspective and wherein the second cavity has dovetail shaped sidewalls and is sized to receive the second protrusion once the second protrusion is subjected to the intermediate thermal heat treatment process and thermally deforms into position in the second cavity forming the irreversibly interlocked joint.

6. The method of claim 1, wherein joining the first and second core pieces such that the first portion of the protrusion is received in at least a portion of the cavity comprises joining first and second core pieces that are in a green state.

7. The method of claim 1, joining the first and second core pieces such that the first portion of the protrusion is received in at least a portion of the cavity comprises joining first and second core pieces outside of a mold.

8. The method of claim 1, wherein the first core piece is a multi-wall core.

9. The method of claim 1, further comprising forming a core print separately from the core and joining the core print to the core.

10. A method of forming a core for use in casting a turbine engine component comprising:

forming a normal resolution region of the core using a first process of molding; and forming a high resolution region of the core using lithographic molding, which is a method of molding different than the first process and effective to produce high resolution features;

wherein the high resolution region has one or more high resolution features selected from the group consisting of a recess, cavity, opening, protrusion, channel, groove, slot, and depression;

wherein the normal resolution region is defined by a first core piece and the high resolution region is defined by a second core piece;

wherein the first core piece includes a cavity therein;

wherein the second core piece includes a protrusion, joining the first and second core pieces such that a first portion of the protrusion is received in at least a portion of the cavity;

heating the protrusion via an intermediate thermal heat treatment process causing the protrusion to thermally deform to create a three dimensional interlocking joint between the first and second core pieces by allowing thermal creep to irreversibly interlock the first and second core pieces together such that the joint becomes physically locked together providing joint stability through thermal processing; and forming the second core piece with a foil member, wherein a portion of the foil member is embedded in the second core piece and a portion of the foil member protrudes beyond the second core piece; wherein joining the first and second core pieces such that the first portion of the protrusion is received in at least a portion of the cavity comprises inserting the protruding portion of the foil member into the cavity of the first core piece.

11. A method of forming a core for use in casting a turbine engine component comprising:

forming a normal resolution region of the core using a first process of molding; and forming a high resolution region of the core using lithographic molding, which is a method of molding different than the first process and effective to produce high resolution features;

wherein the high resolution region has one or more high resolution features selected from the group consisting of a recess, cavity, opening, protrusion, channel, groove, slot, and depression;

wherein the normal resolution region is defined by a first core piece shaped as an airfoil body portion and the high resolution region is defined by a second core piece shaped as an airfoil body portion, wherein the first and second core pieces form at least a portion of a turbine airfoil;

wherein the first core piece includes a cavity therein;

wherein the second core piece includes a protrusion, joining the first and second core pieces such that a first portion of the protrusion is received in at least a portion of the cavity;

heating the protrusion via an intermediate thermal heat treatment process causing the protrusion to thermally deform to create a three dimensional interlocking joint between the first and second core pieces by allowing thermal creep to irreversibly interlock the first and second core pieces together such that the joint becomes physically locked together providing joint stability through thermal processing;

wherein the cavity is offset from a lateral contact surface such that the cavity is exposed through the first core piece via a neck having a cross-sectional area that is less than the cavity;

inserting a locking member into the cavity housing the protrusion and into at least a portion of space in the cavity which was vacated by the protrusion once the protrusion was thermally deformed during the intermediate thermal heat treatment process.

12. The method of claim 11, wherein the protrusion forms a tongue in groove joint that after being subject to the intermediate thermal heat treatment process forms an irreversibly interlocked joint.

13. The method of claim 11, wherein the neck is offset relative to the cavity such that the neck is closer to an outer surface of the first core piece than another outer surface.

14. The method of claim 11, wherein the protrusion is formed from first and second protrusions extending from the second core piece at acute angles relative to a longitudinal axis in a first perspective, wherein the first protrusion has a dovetail shape with outer sidewalls extending axially away from each other at acute angles from the longitudinal axis in a second perspective 90 degrees to the first perspective, wherein the first and second protrusions are separated by open space positioned therebetween, wherein the cavity in the first core piece comprises first and second cavities formed to receive the first and second protrusions, wherein the first cavity has dovetail shaped sidewalls and is sized to receive the first protrusion once the first protrusion is subjected to the intermediate thermal heat treatment process and thermally deforms into position in the first cavity forming the irreversibly interlocked joint, wherein a portion of the first core piece separates the first cavity from the second cavity.

15. The method of claim 14, wherein the second protrusion has a dovetail shape with outer sidewalls extending axially away from each other at acute angles from the longitudinal axis in a second perspective 90 degrees to the first perspective and wherein the second cavity has dovetail shaped sidewalls and is sized to receive the second protrusion once the second protrusion is subjected to the intermediate thermal heat treatment process and thermally deforms into position in the second cavity forming the irreversibly interlocked joint.

16. The method of claim 11, further comprising forming the second core piece with a foil member, wherein a portion of the foil member is embedded in the second core piece and a portion of the foil member protrudes beyond the second core piece; wherein joining the first and second core pieces such that the first portion of the protrusion is received in at least a portion of the cavity comprises inserting the protruding portion of the foil member into the cavity of the first core piece.

* * * * *